US009767812B2

(12) United States Patent
Marko et al.

(10) Patent No.: US 9,767,812 B2
(45) Date of Patent: Sep. 19, 2017

(54) SYSTEM AND METHOD FOR INCREASING TRANSMISSION BANDWIDTH EFFICIENCY ("EBT2")

(71) Applicant: Sirius XM Radio Inc., New York, NY (US)

(72) Inventors: Paul Marko, Pembroke Pines, FL (US); Deepen Sinha, Chatham, NJ (US); Hariom Aggrawal, Noida (IN)

(73) Assignee: Sirus XM Radio Inc., New York, NY (US)

( * ) Notice: Subject to any disclaimer, the term of this patent is extended or adjusted under 35 U.S.C. 154(b) by 90 days.

(21) Appl. No.: 14/226,788

(22) Filed: Mar. 26, 2014

(65) Prior Publication Data

US 2014/0297292 A1 Oct. 2, 2014

Related U.S. Application Data

(63) Continuation-in-part of application No. PCT/US2012/057396, filed on Sep. 26, 2012.
(Continued)

(51) Int. Cl.
*G10L 19/008* (2013.01)
*G10L 19/00* (2013.01)
(Continued)

(52) U.S. Cl.
CPC ..... *G10L 19/008* (2013.01); *G10L 19/00* (2013.01); *H04H 60/58* (2013.01);
(Continued)

(58) Field of Classification Search
CPC ... G10L 19/008; G10L 19/00; G10L 19/0212; G10L 2019/0001
(Continued)

(56) References Cited

U.S. PATENT DOCUMENTS 6,668,092 B1 * 12/2003 Sriram ..... H03M 7/30 382/244
6,789,123 B2 9/2004 Jin et al.
(Continued)

FOREIGN PATENT DOCUMENTS

WO WO0131497 A1 5/2001
WO WO2006010003 A2 1/2006

OTHER PUBLICATIONS

Kastner, Thorsten, et al. "MPEG-7 scalable robust audio fingerprinting." Audio Engineering Society Convention 112. Audio Engineering Society, 2002.*
(Continued)

*Primary Examiner* — Edwin S Leland, III
(74) *Attorney, Agent, or Firm* — Kramer Levin Naftalis & Frankel LLP

(57) ABSTRACT

Systems and methods for increasing transmission bandwidth efficiency by the analysis and synthesis of the ultimate components of transmitted content are presented. To implement such a system, a dictionary or database of elemental codewords can be generated from a set of audio clips. Using such a database, a given arbitrary song or other audio file can be expressed as a series of such codewords, where each given codeword in the series is a compressed audio packet that can be used as is, or, for example, can be tagged to be modified to better match the corresponding portion of the original audio file. Each codeword in the database has an index number or unique identifier. For a relatively small number of bits used in a unique ID, e.g. 27-30, several hundreds of millions of codewords can be uniquely identified. By providing the database of codewords to receivers of a broadcast or content delivery system in advance, instead of broadcasting or streaming the actual compressed audio signal, all that need be transmitted is the series of identifiers along with any modification instructions to the identified
(Continued)

codewords. After reception, intelligence on the receiver having access to a locally stored copy of the dictionary can reconstruct the original audio clip by accessing the codewords via the received IDs, modify them as instructed by the modification instructions, further modify the codewords either individually or in groups using the audio profile of the original audio file (also sent by the encoder) and play back a generated sequence of phase corrected codewords and modified codewords as instructed. In exemplary embodiments of the present invention, such modification can extend into neighboring codewords, and can utilize either or both (i) cross correlation based time alignment and (ii) phase continuity between harmonics, to achieve higher fidelity to the original audio clip.

14 Claims, 27 Drawing Sheets

Related U.S. Application Data

(60) Provisional application No. 61/539,136, filed on Sep. 26, 2011.

(51) Int. Cl.
*H04H 60/58* (2008.01)
*G10L 19/02* (2013.01)

(52) U.S. Cl.
CPC .. *G10L 19/0212* (2013.01); *G10L 2019/0001* (2013.01); *H04H 2201/18* (2013.01)

(58) Field of Classification Search
USPC ..... 704/500
See application file for complete search history.

(56) References Cited

U.S. PATENT DOCUMENTS 7,376,710 B1 * 5/2008 Cromwell ..... H04M 3/493 379/1.02
7,953,605 B2 * 5/2011 Sinha ..... G10L 21/038 704/200.1
8,280,889 B2 * 10/2012 Whitman ..... G06F 17/30743 700/94
8,306,976 B2 * 11/2012 Handman ..... G06F 17/30017 707/733
2002/0083060 A1 * 6/2002 Wang ..... G06F 17/30743
2002/0143541 A1 * 10/2002 Kondo ..... G10L 13/06 704/258
2003/0036948 A1 * 2/2003 Woodward ..... G06Q 30/02 709/231
2003/0135631 A1 * 7/2003 Li ..... H04L 29/06027 709/231
2004/0243540 A1 * 12/2004 Moskowitz ..... H04L 63/0428
2005/0182629 A1 * 8/2005 Coorman ..... G10L 13/07 704/266
2005/0287971 A1 * 12/2005 Christensen ..... G06Q 30/0267 455/186.1
2006/0034287 A1 * 2/2006 Novack ..... G06F 21/32 370/395.2
2006/0149552 A1 * 7/2006 Bogdanov ..... G10L 25/48 704/273
2007/0005795 A1 * 1/2007 Gonzalez ..... G06F 17/30017 709/232
2007/0011009 A1 * 1/2007 Nurminen ..... G10L 13/06 704/260
2007/0011699 A1 * 1/2007 Kopra ..... H04H 60/48 725/22
2007/0083367 A1 * 4/2007 Baudino ..... G10L 19/0018 704/235
2008/0082510 A1 * 4/2008 Wang ..... H04H 60/37
2008/0115655 A1 * 5/2008 Weng ..... G10H 1/0008 84/609
2009/0041231 A1 * 2/2009 Yang ..... H04L 9/00 380/28
2009/0097551 A1 * 4/2009 Zhang ..... H04N 19/159 375/240.03
2009/0267895 A1 * 10/2009 Bunch ..... G06F 3/0386 345/157
2010/0057448 A1 * 3/2010 Massimino ..... G10L 19/04 704/222
2010/0145690 A1 * 6/2010 Watanabe ..... G10L 13/033 704/210
2010/0280832 A1 * 11/2010 Ojala ..... H04L 65/608 704/500
2010/0325135 A1 * 12/2010 Chen ..... G06F 17/30053 707/759
2011/0021136 A1 * 1/2011 Patsiokas ..... H04H 40/90 455/3.06
2011/0034176 A1 * 2/2011 Lord ..... G06F 17/30244 455/450
2011/0041154 A1 * 2/2011 Olson ..... G06F 17/30787 725/54
2011/0082877 A1 * 4/2011 Gupta ..... G10L 25/00 707/769
2011/0173185 A1 * 7/2011 Vogel ..... G06F 17/30038 707/722
2011/0311095 A1 * 12/2011 Archer ..... G06K 9/00744 382/100
2012/0065753 A1 * 3/2012 Choo ..... G10L 19/18 700/94
2012/0239690 A1 * 9/2012 Asikainen ..... G06F 17/3082 707/770
2012/0278067 A1 * 11/2012 Morii ..... G10L 19/107 704/205
2013/0007865 A1 * 1/2013 Krishnamurthy ..... G06F 21/552 726/7
2013/0064383 A1 * 3/2013 Schnell ..... G10L 19/012 381/71.12
2013/0065213 A1 * 3/2013 Gao ..... G10H 1/365 434/307 A
2014/0188592 A1 * 7/2014 Herberger ..... G06Q 30/0239 705/14.39
2014/0325354 A1 * 10/2014 Zhang ..... G06F 3/04842 715/716
2014/0336797 A1 * 11/2014 Emerson, III ..... H04H 60/37 700/94
2015/0199974 A1 * 7/2015 Bilobrov, I ..... G10L 19/018 700/94
2015/0229756 A1 * 8/2015 Raniere ..... H04W 12/06 455/411
2015/0262588 A1 * 9/2015 Tsutsumi ..... G10L 19/125 704/207

OTHER PUBLICATIONS

International Search Report Application No. PCT/US2012/057396, Application Filing Date Sep. 26, 2012, Date of Mailing Feb. 27, 2013.

* cited by examiner

FIG. 3
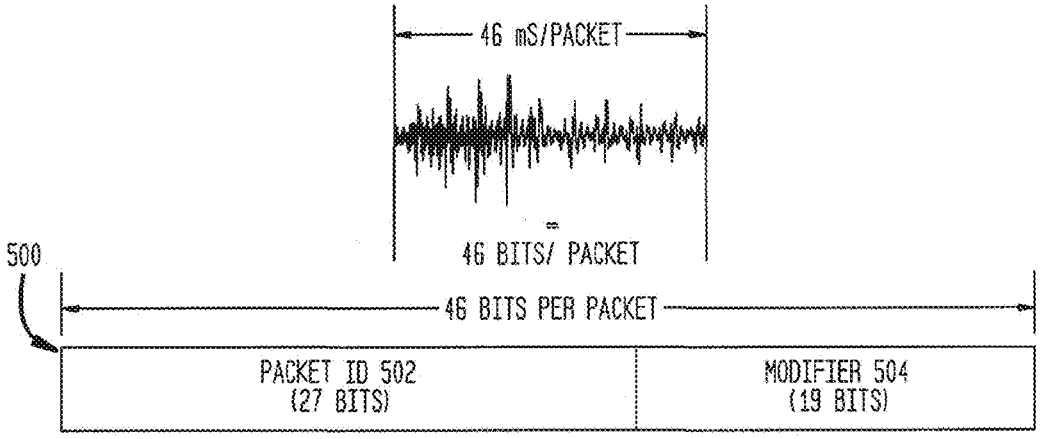
FIG. 4
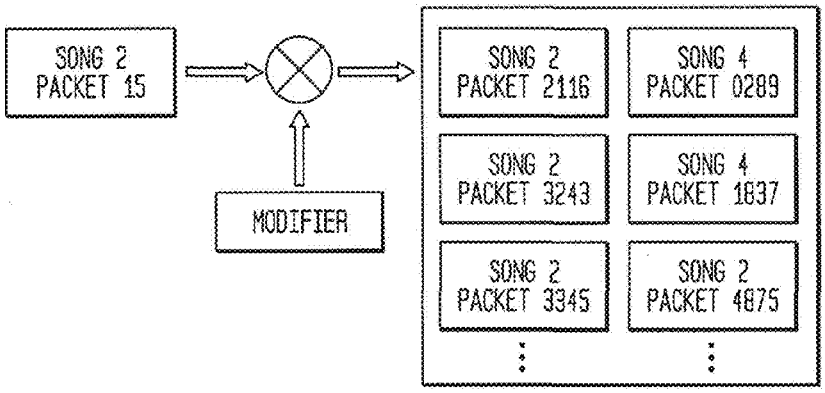
FIG. 5
| SONG # | PACKETS | NEW PACKETS |
|---|---|---|
| 1 | 5,000 | 4,500 |
| 2 | 5,000 | 4,500 |
| ⋮ | ⋮ | ⋮ |
| 1000 | 5,000 | 2,500 |
| 1001 | 5,000 | 2,500 |
| ⋮ | ⋮ | ⋮ |
| 5,000 | 5,000 | 1,000 |
| 5,001 | 5,000 | 1,000 |
| ⋮ | ⋮ | ⋮ |
| 20,000 | 5,000 | 50 |

EBT2 CODEC

ENCODER

DECODER

FIG. 22

| RADIO PERSONALIZATION PARAMETERS | STANDARS MUSIC CHANNELS | ADDITIONAL 200 EBT MUSIC CHANNELS |
|---|---|---|
| SONG IN CIRCULAR BUFFER (More songs improves initial stream quality) | 48 | 480 |
| SIMILAR GENRE CHANNELS (Similar channels increase probability of a good match) | 1X | 4X (1+3) |
| SONGS RECEIVED PER MINUTE | 20 | 77 |

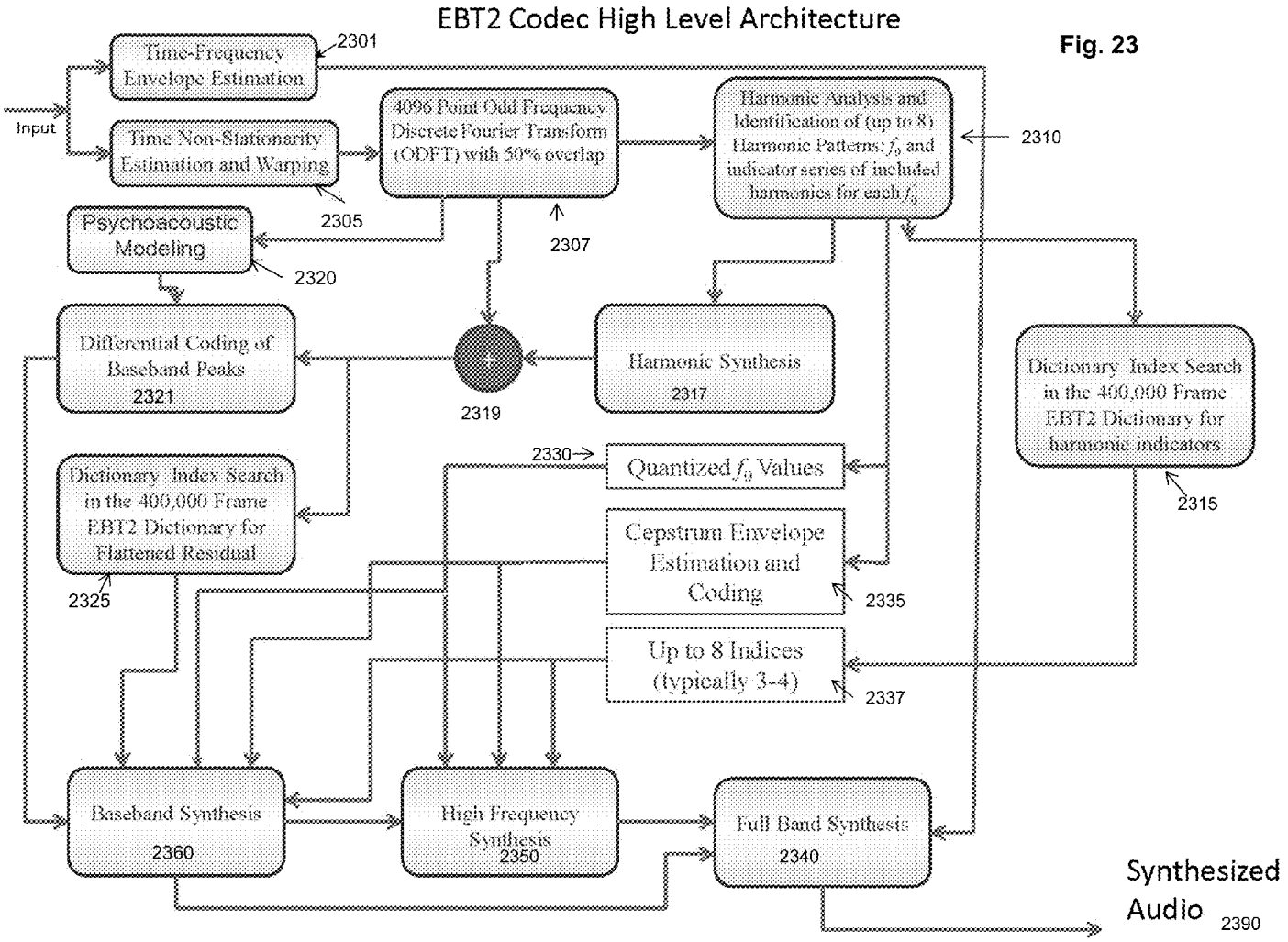
EBT2 Codec High Level Architecture
Fig. 23
Input
Time-Frequency Envelope Estimation
2301
Time Non-Stationarity Estimation and Warping
2305
4096 Point Odd Frequency Discrete Fourier Transform (ODFT) with 50% overlap
2307
Harmonic Analysis and Identification of (up to 8) Harmonic Patterns: $f_0$ and indicator series of included harmonics for each $f_0$
2310
Psychoacoustic Modeling
2320
Harmonic Synthesis
2317
2319
Differential Coding of Baseband Peaks
2321
Dictionary Index Search in the 400,000 Frame EBT2 Dictionary for Flattened Residual
2325
Dictionary Index Search in the 400,000 Frame EBT2 Dictionary for harmonic indicators
2315
Quantized $f_0$ Values
2330
Cepstrum Envelope Estimation and Coding
2335
Up to 8 Indices (typically 3-4)
2337
Baseband Synthesis
2360
High Frequency Synthesis
2350
Full Band Synthesis
2340
Synthesized Audio
2390

Accurate Psychoacoustic Model

Fig. 25
Accurate Psychoacoustic Model
- Accurate harmonic analysis to detect the presence of tones and harmonic components
  - New techniques for estimation of tone frequencies (with sub-bin accuracy), magnitude, and phase
  - Cepstrum based algorithms for harmonic detection
  - Correction based on hysteresis and likelihood models
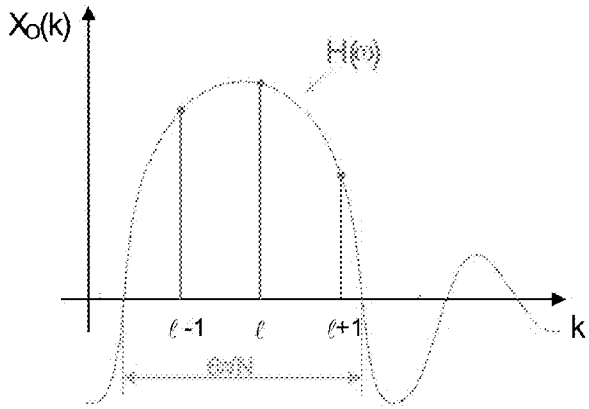
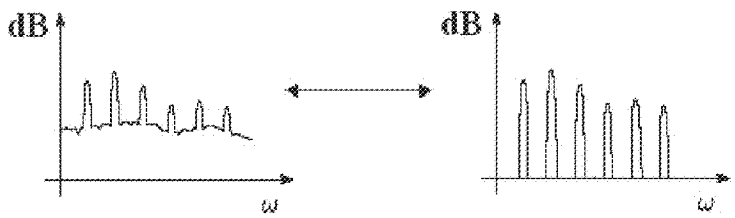

Accurate Psychoacoustic Model

- Accurate Modeling of Wideband Masking Considerations
  - Masking Threshold for a wide band masker (>critical band) can be substantially lower than a narrow band masker
  - Known as *"Comodulation Masking Release" (CMR)* in hearing literature, this is rigorously modeled.

Fig. 27

Accurate Psychoacoustic Model

*Illustrative Example of the model in use in AAC/PAC codecs (with 2048/256 frame lengths):* Increased Efficiency - ~9% reduction in bit demand -along with accuracy with improved harmonic analysis

2710

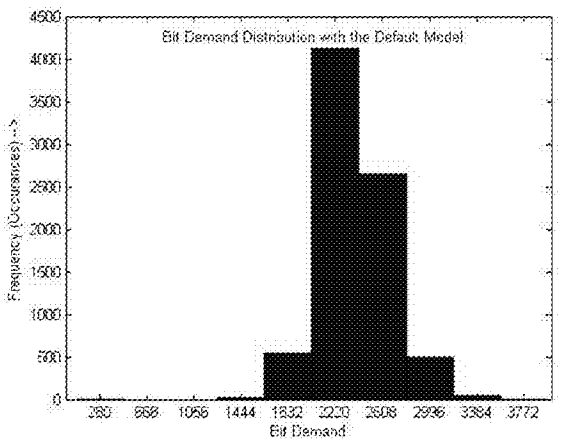

Distribution of per frame bit demand using the old Psychoacoustic Model

2720

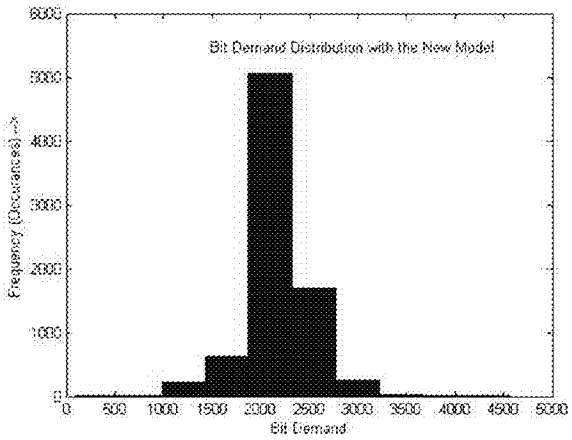

Distribution of per frame bit demand using the Enhanced "Accurate Psychoacoustic Model" (~average 9% reduction)

Fig. 28

EBT2 Codec Structure

| Information | Coding | Bit Count | Separate | Peak bps | Average bps | Comments |
|---|---|---|---|---|---|---|
| Number of Harmonics | Direct | 3 | No | 50 | 50 | |
| *f0, f1, .. f7* | Direct | 12 bit/fundamental Onset frames | Yes | 1500 | 300 | |
| Warping function | Direct | 8 bit/frame | Yes | 125 | 50 | |
| Cepstrum Smooth Envelope | | | Y/N | 800 | 750 | |
| Harmonic Locations | Dictionary | 20bits/harmonic | Yes | 2500 | 1250 | Replaced by differential cepstrum envelope in sustained frames |
| Start Phase of Harmonics | Direct | 11 bits/harmonic onset frames | Yes | 1375 | 400 | *Phase Continuation Algorithm* used in sustained frames |
| Residual Shape | Dictionary | 4 x 20 bits | No | 1250 | 1250 | |
| Residual Attenuation | Direct | 4 x 4 bits | No | 200 | 200 | |
| Differential Baseband Coding | Direct | | Yes | 1500 | 1200 | |
| High Frequency Extension Indices | Direct | 8 bits/frame | No | 50 | 50 | |
| Time-Frequency Envelope | Direct & Dictionary | | No | 3000 | 2000 | |

Fig. 29

Exemplary Match Statistics for Harmonic Locations

Angie.wav

| Fundamental | (%) No mismatches | (%) One mismatch |
|---|---|---|
| F0 | 79.84 | 94.74 |
| F1 | 72.16 | 88.67 |
| F2 | 74.43 | 89.13 |
| F3 | 77.68 | 90.65 |
| F4 | 79.15 | 89.74 |
| F5 | 83.97 | 88.73 |
| F6 | 87.89 | 89.24 |
| F7 | 92.00 | 96.00 |
| | | |

Beast of Burden.wav

| Fundamentals | (%) One mismatch | (%) Two mismatches |
|---|---|---|
| F0 | 80.30 | 97.08 |
| F1 | 83.38 | 90.17 |
| F2 | 70.75 | 86.83 |
| F3 | 78.82 | 82.97 |
| F4 | 75.23 | 87.75 |
| F5 | 78.80 | 80.01 |
| F6 | 76.73 | 87.76 |
| F7 | 79.75 | 81.01 |

Fig. 30

Exemplary Match Statistics for Harmonic Locations

Emotional Rescue.wav

| Fundamentals | (%) One mismatch | (%) Two mismatches |
|---|---|---|
| F0 | 80.25 | 97.66 |
| F1 | 81.54 | 97.75 |
| F2 | 82.98 | 91.65 |
| F3 | 79.87 | 94.88 |
| F4 | 85.32 | 88.35 |
| F5 | 70.33 | 89.47 |
| F6 | 71.49 | 88.76 |
| F7 | 70.57 | 77.69 |

Brown Sugar.wav

| Fundamentals | (%) One mismatch | (%) Two mismatches |
|---|---|---|
| F0 | 83.54 | 96.10 |
| F1 | 88.45 | 93.39 |
| F2 | 76.85 | 95.23 |
| F3 | 75.28 | 93.91 |
| F4 | 78.96 | 95.03 |
| F5 | 82.13 | 90.38 |
| F6 | 85.94 | 91.60 |
| F7 | 86.84 | 93.33 |

Start Me Up.wav

| Fundamentals | (%) One mismatch | (%) Two mismatches |
|---|---|---|
| F0 | 84.85 | 99.23 |
| F1 | 82.69 | 98.86 |
| F2 | 78.47 | 94.70 |
| F3 | 70.62 | 97.14 |
| F4 | 75.27 | 93.51 |
| F5 | 78.95 | 94.49 |
| F6 | 78.64 | 91.39 |
| F7 | 76.38 | 99.41 |

SYSTEM AND METHOD FOR INCREASING TRANSMISSION BANDWIDTH EFFICIENCY ("EBT2")

CROSS-REFERENCE TO RELATED APPLICATIONS

This application is a continuation-in-part of international patent application no. PCT/US2012/057396, which was filed on Sep. 26, 2012, and published as WO/2013/049256, entitled SYSTEM AND METHOD FOR INCREASING TRANSMISSION BANDWIDTH EFFICIENCY ("EBT2"), and which claims the benefit of U.S. Provisional Patent Application No. 61/539,136, entitled SYSTEM AND METHOD FOR INCREASING TRANSMISSION BANDWIDTH EFFICIENCY, filed on Sep. 26, 2011, the disclosures of each of which are hereby fully incorporated by reference.

Reference to a Computer Program Listing Appendix

This application contains a computer program listing appendix which is incorporated by reference in its entirety. That appendix. has been submitted electronically via EFS-Web in an ASCII text file named 09990830945.txt, sized 49 KB, and created on Jun. 16, 2017.

TECHNICAL FIELD

The present disclosure relates generally to broadcasting, streaming or otherwise transmitting content, and more particularly, to a system and method for increasing transmission bandwidth efficiency by analysis and synthesis of the ultimate components of such content.

BACKGROUND OF THE INVENTION

Various systems exist for delivering digital content to receivers and other content playback devices. These include, for example, in the audio domain, satellite digital audio radio services (SDARS), digital audio broadcast (DAB) systems, high definition (HD) radio systems, and streaming content delivery systems, to name a few, or in the video domain, for example, video on-demand, cable television, and the like.

Since available bandwidth in a digital broadcast system and other content delivery systems is often limited, efficient use of transmission bandwidth is desirable. For example, governments allocate to satellite radio broadcasters, such as Sirius XM Radio Inc. in the United States, a fixed available bandwidth. The more optimally it is used, the more channels and broadcast services that can be provided to customers and users. In other contexts, bandwidth accessible to a user is often charged on an as-used basis, such as, for example, in the case of many data plans offered by cellular telephone services. Thus, if customers use more data to access a music streaming service on their telephones, for example, they pay more. An ongoing need therefore exists for digital content delivery systems of every type to transmit content in an optimal manner so as to optimize transmission bandwidth whenever possible.

One illustrative content delivery system is disclosed in U.S. Pat. No. 7,180,917, under common assignment herewith. In that system, content segments such as full copies of popular songs are pre-stored at various receivers in a digital broadcast system to improve broadcast efficiency. The broadcast signal therefore only need include a string of identifiers of the songs stored at the receivers as part of a programming channel, as opposed to transmitting compressed versions of full copies of those songs, thereby saving transmission bandwidth. The receivers, in turn, upon receipt of the string of song identifiers, selectively retrieve from local memory and then playback those stored content segments corresponding to the identifiers recovered from the received broadcast signal. The content delivery system disclosed in U.S. Pat. No. 7,180,917, however, does have disadvantages. For example, while broadcast efficiency is improved, storing full copies of songs on the receivers is a clumsy solution. It requires using large amounts of receiver memory, and continually updating the song library on each receiver with full copies of each and every new song that comes out. To do this requires using the broadcast stream or other delivery method, such as an IP connection to the receiver over a network or the Internet, to download the songs in the background or at off hours to each receiver, and thus requires them to be on for such updates.

Thus, a need exists for a method of improving the efficiency of broadcasting, streaming or otherwise transmitting content to receivers, so as to optimize available bandwidth, and significantly increase the available channels and/or quality of them, using the same, now optimized, bandwidth, without physically copying an ever evolving library of songs and other audio content onto each receiver, while at the same time minimizing the use of receiver memory and the need for updates.

SUMMARY OF THE INVENTION

Systems and method for increasing bandwidth transmission efficiency by the analysis and synthesis of the ultimate components of transmitted contents are presented. In exemplary embodiments of the present invention, elemental codewords are used as bit representations of compressed packets of content for transmission to receivers or other playback devices. Such packets can be components of audio, video, data and any other type of content that has regularity and common patterns, and can thus be reconstructed from a database of component elements for that type or domain of content. The elemental codewords can be predetermined to represent a range of content and to be reusable among different audio or video tracks or segments.

To implement such a system, a dictionary or database of elemental codewords, sometimes referred to herein as "preset packets," may be generated from a set of, for example, audio or video clips. Using such a database, a given audio or video segment or clip (that was not in the original training set) is expressed as a series of such preset packets, where each given preset packet in the series is a compressed packet that (i) can be used as is, or, for example, (ii) should be modified to better match the corresponding portion of the original audio clip. Each preset packet in the database is assigned an index number or unique identifier ("ID"). It is noted that for a relatively small number of bits (e.g. 27-30) in an ID, many hundreds of millions of preset packets can be uniquely identified. By providing the database of preset packets to receivers of a broadcast or content delivery system in advance, instead of broadcasting or streaming the actual audio signal, the series of identifiers, along with any modification instructions for the identified preset packet, is transmitted over a communications channel, such as, for example, an SDARS satellite broadcast, a satellite or cable television broadcast, or a broadcast or unicast over a wireless communications network. After reception, a receiver or other playback device, using its locally stored copy of the database, reconstructs the original audio or video clip by accessing the identified preset packets, via their received unique identifiers, and modifies them as instructed by the modification instructions, if any, and can then play back the series of preset packets, either with or without modification, as instructed, to reconstruct the original content. In exemplary embodiments of the present invention, to achieve better fidelity to the original content signal, such modification can also extend into neighboring or related preset packets. For example, in the case of audio content, such modification can utilize (i) cross correlation based time alignment and/or (ii) phase continuity between harmonics, to achieve higher fidelity to the original audio clip.

In the case of audio programming, to create such a database of preset packets, digital audio segments (e.g., songs) are first encoded into compressed audio packets. Then the compressed audio packets are processed to determine if a stored preset packet already in the preset packets database optimally represents each of the compressed audio packets, taking into consideration that the optimal preset packet selected to represent a particular compressed audio packet may require a modification to reproduce the compressed audio packet with acceptable sound quality. Thus, when a preset packet corresponding to the selected packet is stored in a receiver's memory, only the bits needed to indicate the optimal preset packet's ID and to represent any modification thereof are transmitted in lieu of the compressed audio packet. The preset packets can be stored (e.g., in a preset packet database) at or otherwise in conjunction with both the transmission source and the various receivers or other playback devices prior to transmission of the content.

Upon reception of the transmitted data stream of preset packets, in the {ID+modification instructions} format, a receiver performs lookup operations via its preset packets database, using the transmitted IDs to obtain the corresponding preset packets, and performs any necessary modification of the preset packet (e.g., as indicated in transmitted modification bits) to decode the reduced bit transmitted stream (i.e., sequence of {Unique ID+Modifier}) into the corresponding compressed audio packets of the original song or audio content clip. The compressed audio packets can then be decoded into the source content (e.g., audio) segment or stream, and played to a user.

A significant advantage of the disclosed invention derives from the reusability of elemental codewords (preset packets). This is because at the elemental level (looking at very small time intervals) many songs, video signals, data structures, etc., use very similar, or actually the same, pieces over and over. For example, a 46 msec piece of a given drum solo is very similar, if not the same, as that found in many known drum solos, and a 46 msec interval of Taylor Swift playing the D7 guitar chord is the same as in many other songs where she plays a D7 guitar chord. Such similarity may be an even better match on various metrics if an instrument (here a guitar, for example) with the same or nearly the same color or timbre is used to play each chord. Thus, in some embodiments an even finer matchmay be created by segnmenting elemental codewords by instrument, tibre, type, etc. Thus, in various exemplary embodiments, the elemental codewords, acting as letters in a complex alphabet, can be reusable among different audio tracks.

The use of configurable, reusable, synthetic preset packets and packet IDs in accordance with illustrative embodiments of the present invention realizes a number of advantages over existing technology used to increase transmission bandwidth efficiency. For example, using this technology, transmitted music channels can be streamed at 1 kpbs or less. Bandwidth efficient live broadcasts are enabled with the use of real-time music encoders that implement the use of configurable preset packets by mapping the real time signal to the database of preset packets to generate an output signal (with slight delay). Further, the use of fixed song or other content tables at the receiver is obviated by the use of receiver flash memory containing a base set of reusable and configurable preset packets. In addition to leveraging existing perceptual audio compression technology (e.g., USAC), the audio analysis used to create the database of configurable preset packets and to encode content using the preset packets, in accordance with illustrative embodiments of the present invention, enables more efficient broadcasting of content, such as, for example, audio content.

While the detailed description of the present invention is described in terms of broadcasting audio content (such as songs), the present invention is not so limited and is applicable to the transmission and broadcast of other types of content, including video content (such as television shows or movies).

BRIEF DESCRIPTION OF THE DRAWINGS

The invention will be more readily understood with reference to various exemplary embodiments thereof, as shown in the drawing figures, in which:

FIG. 3 depicts an exemplary reduced bit reduced bit {ID+modification instructions} representation of an audio packet according to an exemplary embodiments of the present invention;

FIG. 4 depicts an example of modifying a preset packet according to an exemplary embodiment of the present invention so as to be useable in place of multiple packets;

FIG. 5 illustrates preset how preset packet reuse can be used to require few if any additional preset packet packets to be added to an exemplary database once a sufficient number of preset packets has been stored according to an exemplary embodiment of the present invention;

FIGS. 21-22 illustrate a personalized radio technique implemented on a receiver of a multi-channel broadcast exploiting the benefits of exemplary embodiments of the present invention;

FIG. 23 depicts an exemplary high level codec architecture according to an exemplary embodiment of the present invention;

FIG. 25 illustrates the detailed harmonic analysis aspect of the Accurate Psychoacoustic Model of FIG. 24;

FIG. 27 illustrates a comparison of per frame bit demand for a conventional psychoacoustic model, and the inventive Accurate Psychoacoustic Model of FIG. 24;

FIG. 28 presents details and specifications of an exemplary EBT2 codec structure according to exemplary embodiments of the present invention; and FIGS. 29-30 provide exemplary match statistics for various harmonic locations obtained by processing five exemplary audio clips according to an exemplary embodiment of the present invention.

DETAILED DESCRIPTION OF THE INVENTION

Figure 1:
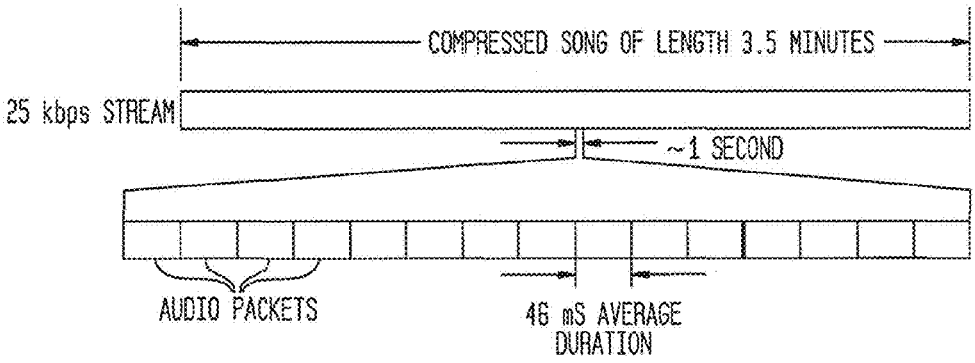
FIG. 1 illustrates an exemplary compressed audio stream structure.

FIG. 1 illustrates an exemplary structure for an audio stream to be transmitted (e.g., broadcast or streamed). In one example, an audio source such as a digital song of approximately 3.5 minutes in duration can be compressed using perceptual audio compression technology, such as, for example, a unified speech and audio coding (USAC) algorithm. Other encoding techniques can also be used for example, as may be known in the art, such as AAC/PAC. In the exemplary structure of FIG. 1, the song can be converted into a 24 kilobit per second (kbps) stream that is divided into a number of audio packets of a fixed or variable length that can each produce, on average, about 46 milliseconds (ms) of uncompressed audio. In the example of FIG. 1, about 4,565 compressed audio packets are required with a song length of about 210 seconds.

In accordance with an embodiment of the present invention, a database of reusable, configurable and synthetic preset packets or codewords can be, for example, used as elemental components of audio clips or files, and said database can be pre-loaded on, or for example, transmitted to, receivers or other playback devices. It is noted that such a database can also be termed a "dictionary", and this terminology is, in fact, used in some of the exemplary code modules described below. Thus, in the present disclosure, the terms "database" and "dictionary" will be used interchangeably to refer to a set of packets or codewords which can be used to reconstruct an arbitrary audio clip or file. The preset packets can, for example, be predetermined to represent a range of audio content and can, for example, be reusable as elements of different audio tracks or segments (e.g., songs). The preset packets can be stored (e.g., in a preset packets database) at or otherwise in conjunction with both (i) the transmission source for the audio tracks or segments and (ii) the receivers or other playback devices, prior to transmission and reception, respectively, of the content that the preset packets are used to represent.

Figure 2:
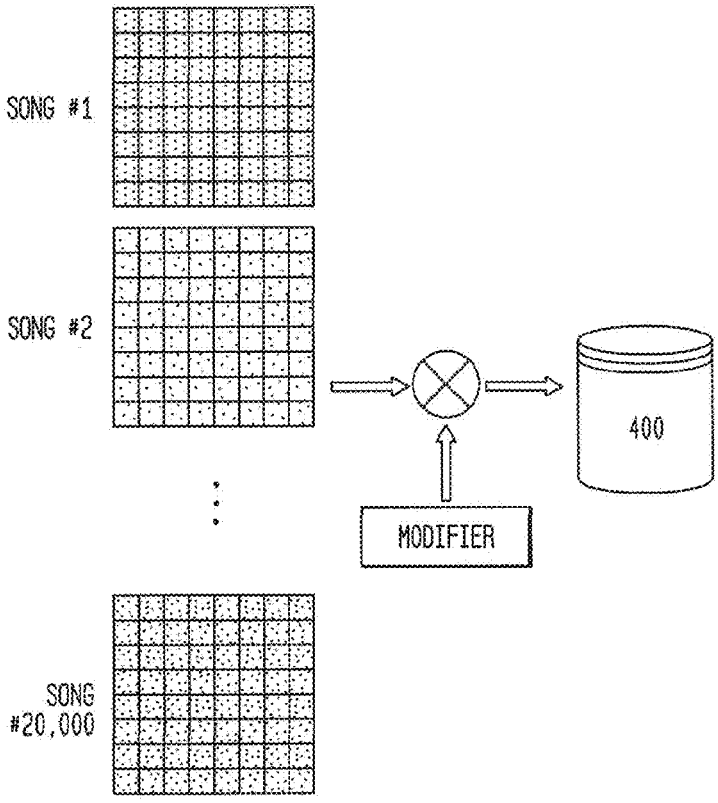
FIG. 2 depicts generating a database of preset packets from an exemplary 20,000 training set according to an exemplary embodiment of the present invention.

FIG. 2 illustrates the contents of an exemplary database 400 having configurable and reusable synthetic preset packets stored therein. As noted above, database 400 can store synthetic preset packets to be used in representing an audio stream of FIG. 1, for example. From a sequence of the actual preset packets to a sequence of indices to them, a much smaller stream (e.g., 1 kbps stream from a 24 kbps stream) results. By providing such reduced bit indices to "generic" reusable audio packets (e.g., developed from a plurality of sample audio streams such as songs), the actual audio, for example, need not be transmitted or broadcast; rather, the sequence of indices to a pre-known dictionary or database is transmitted or broadcast. Moreover, because the reusable audio packets are common to many different actual audio clips or songs, the database comprising them can be much smaller than the actual size of the same songs stored in their original compressed format.

For example, a set of songs (e.g., 20,000 songs as shown in FIG. 2) having about 5,000 compressed audio packets each, would collectively constitute an actual song database of about 100,000,000 compressed packets, and require about 8 GB of flash memory. Such a database can be significantly compressed or compacted, however, inasmuch as the 5,000 compressed audio packets of each of the 20,000 songs are likely to share the same or somewhat similar compressed audio packets within the same song or with other songs. Thus, the database can be pruned, so to speak, to include only unique synthetic packets needed to reconstitute the compressed audio packets of the entire 20,000 song library, taking into account the fact that a compressed audio packets can be further modified for reuse in reconstituting different songs. Such an approach is akin to a tuxedo rental shop that stocks a certain set of suits and tuxedos for rent. From this stock of suits, the shop can realistically supply an entire city or neighborhood with formal wear. Although most of the suits do not fit exactly a given customer, each suit can be tailored slightly prior to fitting a given customer, as his shape, size and preferences may dictate. By operating in this manner, the tuxedo rental shop does not need to stock a tuxedo tailor made for each and every customer in its clientele. Most suits can, via modification, be made to fit a large number of people in a general size and fit bin or category. By so operating, the storage requirements for the shop are greatly reduced. The same is true for receiver memory when implementing the present invention.

In what follows, the unique synthetic packets are referred to as "preset packets" and each can be provided with a unique identifier (ID). The database or dictionary is organized to associate such a unique identifier with its unique preset packet. In the illustrated example of FIG. 3, an ID of 27 bits can be used to uniquely represent 100,000,000 packets in a database. By modifying these unique packets for reuse to represent the same or similar compressed audio packets in actual songs or other audio segments, the database thus has the capacity to provide additional unique packets that may be needed to reconstruct audio packets in content besides the initial 20,000 sample songs from which the database was constructed.

Thus, in exemplary embodiments of the present invention when content, such as an audio segment, for example, is compressed and converted into packets, and the compressed audio packets are compared with synthetic preset packets already in database 400 (FIG. 2), if the database 400 contains a preset packet that matches one of the compressed audio packets, the 27 bit packet ID of that matching packet can be transmitted in lieu of the compressed audio packet. In many instances, however, the database 400 does not contain a matching synthetic preset packet for a compressed audio packet. In that case, the closest matching, or most optimal, preset packet for representing the compressed audio packet can be used. This synthetic preset packet can, for example, be modified a selected way to more faithfully reproduce the original compressed audio packet within acceptable sound quality. I.e., in terms of the analogy provided above, the tuxedo in stock can be modified or tailored to fit a given client. Instructions for this modification can also be represented as a set of bits, and can be transmitted along with the ID of the selected packet. Thus, the preset packet ID and associated modification bits can be transmitted together in lieu of the actual compressed audio packet. This significantly reduces the bits needed to represent the compressed audio packet and therefore increases transmission bandwidth efficiency.

FIG. 3 illustrates an exemplary data stream packet 500 having 46 bits per packet and representing 46 mS of an audio stream. Packet 500 comprises a packet identifier (ID) 502 represented by 27 bits (i.e., "the in-stock tuxedo" in the analogy described above), and a modifier 504 represented by 19 bits (i.e., the "tailoring instructions to make the in-stock tuxedo fit" in the analogy described above). As noted above, packet ID 502 identifies a unique synthetic preset packet stored in database 400, for example, and modifier 504 identifies a transformation to apply to the preset packet corresponding to packet ID 502 to make it work. Thus, in the illustrated example, a 19 bit modifier permits any of the preset packets in database 400 to be permutated in greater than 65,000 different ways. This increases the degree to which database 400 can be compacted, and is described below in the context of "pruning." In an alternate format, for example, the packet ID for a 46 millisecond preset packet can be represented by 21 bits and the modification information can be represented by 25 bits, which, although reducing the maximum available unique preset packets, increases even further the ways in which each packet may be permutated. I.e., continuing with the analogy, this example stocks even less "off the rack" tuxedos, but allows for more complex and user specific alterations to each one, thereby again serving the same clientele with a well-fitting tuxedo.

While the stream of packets 500 in FIG. 3 represents a stream bit rate of 1 kbps, other stream bit rates with other stream compositions may be used. For example, packet 500 could be constructed with two or more packet IDs, along with modifiers which contain instructions to combine the identified packets. Or, for example, one or more packet IDs with one or more modifiers may be configured dynamically from packet to packet to reproduce the original compressed audio packets.

FIGS. 4 and 5 illustrate maximizing preset packet reuse among representations of songs or other digital content to compact database 400, thereby maximizing the variety of unique preset packets it can store and the variety of content that can be represented in an exemplary reduced bit transmission. As illustrated in FIG. 4, audio packet number 15 of Song 2 can be reused, that is, transformed, using various different modifiers, into several different audio packets of different songs. In the illustrated example of FIG. 4, audio packet number 15 of Song 2 can be transformed into each of audio packets 2116, 3243, and 3345 of Song 2, as well as audio packets 289, 1837, and 4875 of Song 4. Thus, the same packet (e.g., packet 15 of Song 2) can be used for at least two different songs (e.g., Song 2 and Song 4), in various different locations within each song. Thus, database 400, instead of storing audio packets 2116, 3243, and 3345 of Song 2, as well as audio packets 289, 1837, and 4875 of Song 4, need only store audio packet number 15 of Song 2.

As a consequence, database 400 may need only to store, for example, 4,500 unique preset packets as opposed to 5,000 packets to represent an initial song, due to reuse of packets, as modified or not, within that song. As more songs are processed to build the database, fewer new packets need to be added to the database, as many existing packets can be used as is, or as modified. FIG. 5 illustrates the reduction of new audio packets from the 20,000 songs that are stored in database 400 as synthetic preset packets as the songs are processed sequentially in time (i.e., Song 1 is the first song processed for audio packets to be placed into the database, Song 2 is the second song processed, and so on). When Song 1 is placed into the database, an exemplary process of storing the song analyzes the preset packets in the database and determines if any audio packets therein may be reused. For instance, when Song 1 is placed into the database, an exemplary process can begin to store the audio packets in the database and can also identify audio packets from Song 1 that can be reused. Thus, FIG. 5 shows, for example, that for the 5000 overall packets in Song 1, 4,500 new preset packets are required to be stored to represent Song 1, but 500 audio packets can be recreated from those 4,500 preset packets. Similarly, Song 2 requires adding 4,500 new preset packets to be stored in database 400, but 500 can be obtained by reusing existing preset packets (either form Song 1, or Song 2, or both).

As the number of audio packets stored as preset packets in the database is increased, so does the opportunities for reusing preset packets. In the example of FIG. 5, Songs 1,000 and 1,001 each only require 2500 new preset packets to be stored, and by the time Songs 5,000 and 5,001 are added, each only require 1,000 new preset packets to be stored in the database. By the time, for example, Song 20,000 is added, given the large number of preset packets already stored in database 400, only 50 new preset packets need be stored in the database to fully reconstruct Song 20,000. Thus, as the exemplary database grows in size, preset packet reuse increases.

Figure 6:
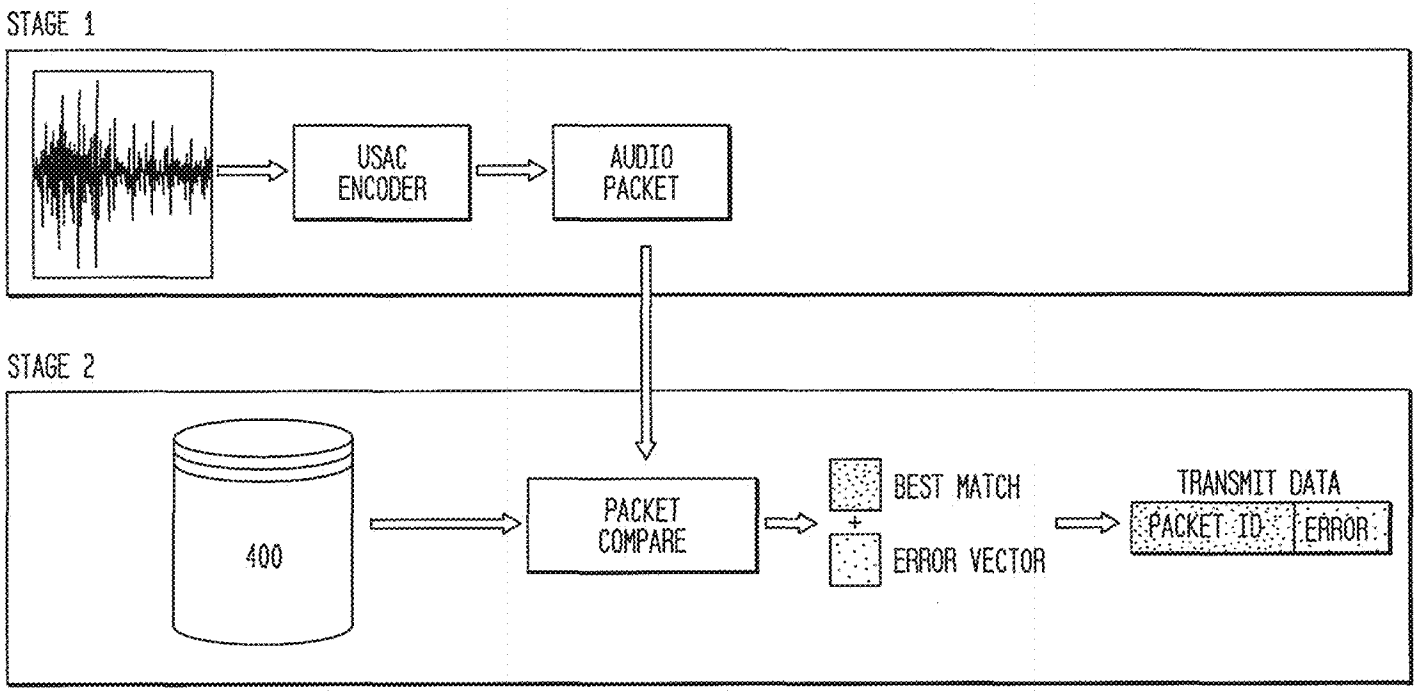
FIG. 6 depicts a general overview of a two-step encoding process according to an exemplary embodiment of the present invention.

FIG. 6 illustrates an exemplary overview of a 2-step encoding process for audio content according to an exemplary embodiment of the present invention. In Stage 1, an encoder receives a source audio stream that is either analog or digital, and encodes the audio stream into a stream of compressed audio packets. For example, a USAC encoder using a perceptual audio compression algorithm can compress the source audio stream into a 24 kbps stream with each audio packet therein comprising about 46 ms of uncompressed audio. In stage 2, a packet compare stage, for example, receives an audio packet from Stage 1, and compares it with a database or dictionary 400, comprising preset packets. The return of such comparison can be a Best Match packet, with an Error Vector, as shown. These data, for example, are transmitted using the format of FIG. 3, as a "Packet ID" field and an "Error" field.

In exemplary embodiments of the present invention, the encoder that is used to generate database 400 is the same type as the encoder used in Stage 1 (i.e., the two encoders use the same fixed configuration).

The USAC encoder used in Stage 1, and also used to generate database 400, is, for example, optimized to improve audio quality. For example, existing USAC encoders are designed to maintain an output stream of coded audio packets with a constant average bit rate. Since the standard encoded audio packets vary in size based on the complexity of such audio content, highly complex portions of audio can result in insufficient bits available for accurate encoding. These periods of bit starvation often result in degraded sound quality. Since the audio stream in the stage 2 encoding process of FIG. 6 is formed with packet IDs and modifiers as opposed to the audio packets, the encoder may be configured to output constant quality packets without the limitation of maintaining a constant packet bit rate.

Figure 7:
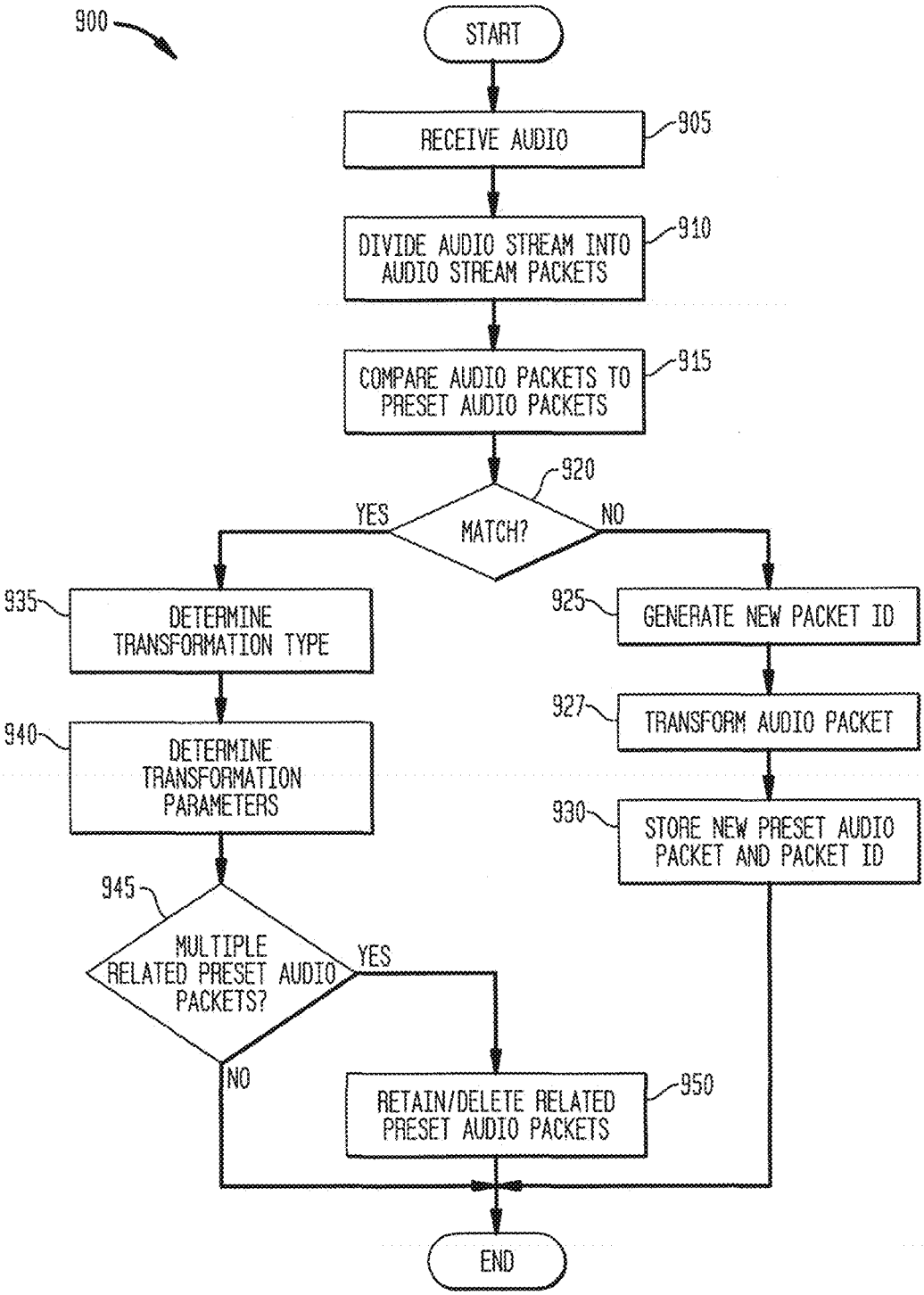
FIG. 7 depicts a process flow chart for building a packet database of preset packets according to an exemplary embodiment of the present invention.

The packet compare function shown in Stage 2 of FIG. 6 identifies a preset packet in database 400 that is a best match to the audio packet provided from stage 1 (e.g., using frequency analysis). The packet compare function also identifies an error vector or other modifier associated with any suitable information needed to modify the matched preset packet to more closely correspond to the audio packet provided from stage 1. After determining the best matching preset packet and error vector, transmission packets are generated and transmitted to a receiving device. The transmission packets illustrated in the example of FIG. 6 comprise a packet ID corresponding to the matched preset packet and bits representing the error vector. The stage 2 packet compare function can be processing intensive depending on the size of the database 400. Parallel processing can be used to implement the packet compare stage. For example, multiple, parallel digital signal processors (DSPs) can be used to compare an audio packet from stage 1 with respective ranges of preset packets in the database 400 and each output an optimal match located from among its corresponding range of preset packets. The plural matches identified by the respective DSPs can then be processed and compared to determine the best matching preset packet, keeping in mind that it may require a modification to achieve acceptable sound quality FIG. 7 illustrates an exemplary process 900 to develop a database 400 of stored configurable, reusable and unique preset packets. In the example of FIG. 7, exemplary process 900 starts by receiving an audio stream at 905. The audio stream is any live or pre-recorded audio stream and may be processed by a codec (e.g., USAC) or analyzed by a fast Fourier transform (FFT) for digital processing. The audio stream is divided into a plurality of audio packets at 910. Each audio packet of the audio stream is then sequentially compared to preset packets stored in, for example, the database 400 at 915. At 920 the exemplary method 900 then determines if there is a suitable match of the audio packet stored in the database 400.

If no a suitable preset packet is identified at 920, a new packet ID is generated at block 925, the audio packet is transformed as a synthetic preset packet at 927, and the resulting preset packet is stored in the database at 930 along with its corresponding packet ID. That is, the audio packet is stored as a synthetic preset packet in the database 400 and has a corresponding packet ID.

Referring back to 920, in the event that exemplary process 900 does identify a suitable preset packet to match the audio packet to (e.g., a preset packet with or without a modifier), the process may determine that there are multiple related preset packets in database 400 which can be consolidated into a single preset packet that can be reused instead to create the respective related preset packets with appropriate modifiers.

Figure 9:
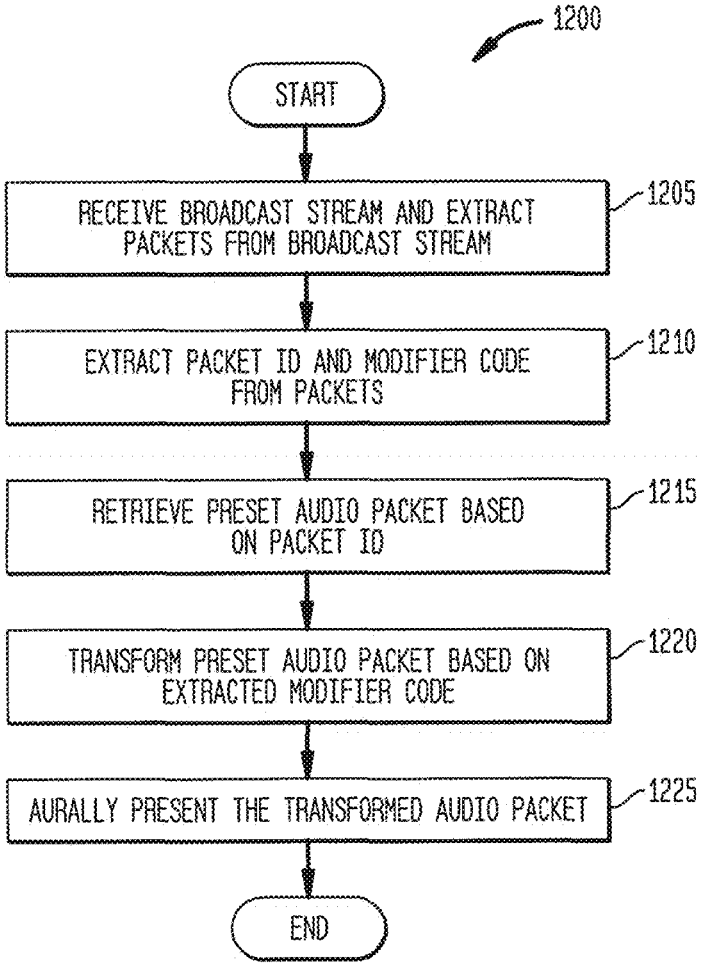
FIG. 9 depicts a process flow chart for receiving, decoding and playing a transmitted stream according to an exemplary embodiment of the present invention.

More specifically and with continued reference to FIG. 7, at 935 exemplary process 900 receives a packet ID of the matched audio packet and determines a transformation type (e.g., a filter, a compressor, etc.) to apply to the matched audio packet at block 935. Exemplary process 900 then determines transformation parameters of the determined transformation type at block 940. In the example of FIG. 9, the transformation is any linear, non-linear, or iterative transformation suitable to cause the audio fidelity of the matched audio packet to substantially represent the audio packet of the received audio stream. As indicated in 945, exemplary process 900 determines if multiple related preset packets exist that can be modified in some manner (e.g., using the transformation parameters). If such multiple related preset packets exist, an existing preset packet can be selected to be maintained in the database 400 and the remaining related preset packets can be deleted, as indicated in block 950. Alternatively, characteristics of one or more of the related preset packets can be used to create one or more new synthetic preset packet with a unique ID to replace all of the multiple related preset packets. This is described more fully below in the context of "pruning" the database.

After storing the new preset packet and corresponding ID at 930, or compacting the database as needed as indicated at block 950, the next audio packet in the audio stream can be processed per blocks 920, 925, 927, 930, 935, 940, 945 and 950 until processing of all packets in the audio stream is completed. Exemplary process 900 is then repeated for the next audio stream (e.g., next song or other audio segment). Once preset packets are stored in a database 400, they are ready for encoding as described above in connection with FIG. 6, for example.

Alternatively, packet database 400 could be generated by first mapping all of the original song packets and then deriving an optimum set of synthesized packets and modifiers to cover the mapped space at various levels of fidelity.

Figure 8:
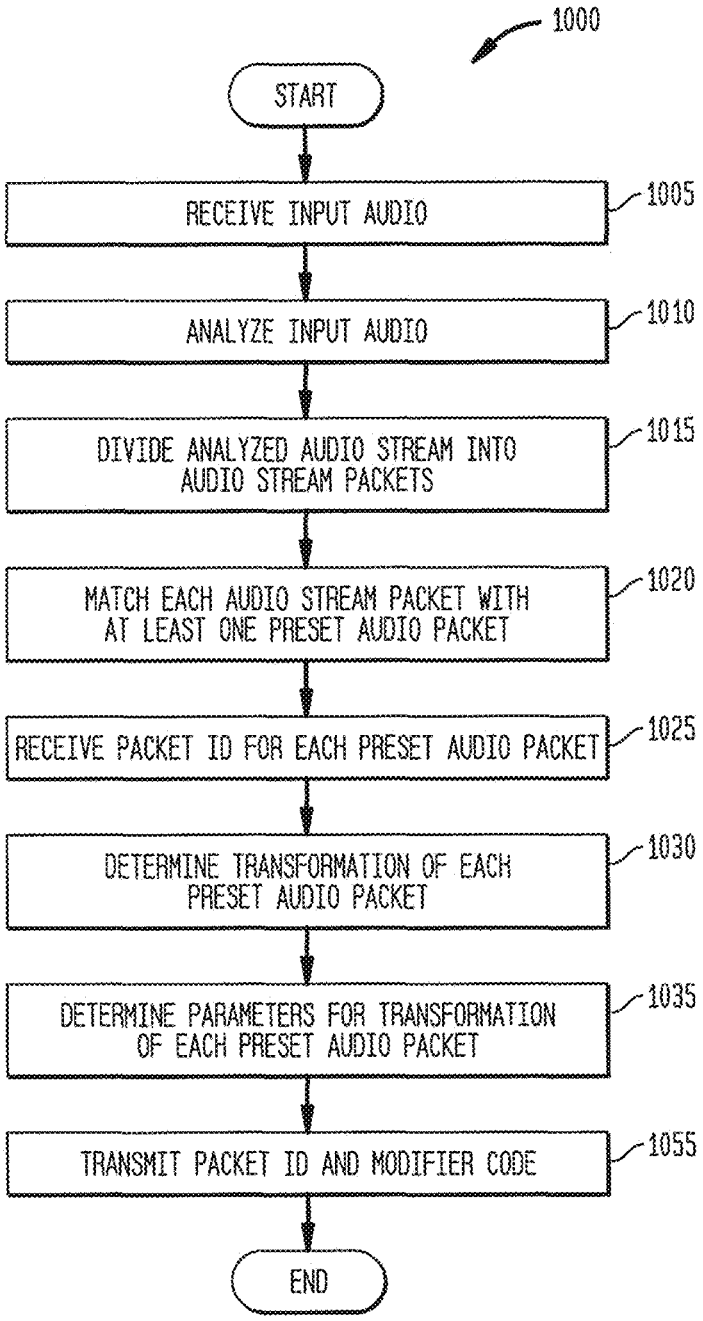
FIG. 8 depicts a process flow chart for encoding input audio, transmitting it, and decoding it, according to an exemplary embodiment of the present invention.

FIG. 8 illustrates exemplary process 1000 for increasing transmission bandwidth by using preset packets to generate a transmitted stream. Initially, at 1005, exemplary process 1000 receives an input audio stream such as a digital audio file, a digital audio stream, or an analog audio stream, for example. At 1010 exemplary process 1000 performs an analysis of the input audio stream to digitally characterize the audio stream. For instance, a fast Fourier transform (FFT) is performed to analyze frequency content of the audio source. In another example, the audio stream is encoded using a perceptual audio codec such as a USAC algorithm. Exemplary process 1000 then divides the analyzed audio stream into a plurality of audio stream packets (e.g., an audio packet representing 46 milliseconds of audio) at 1015.

At 1020, exemplary process 1000 then compares each analyzed audio stream packet with preset packets that are stored in a preset packet database available from any suitable location (e.g., a relational database, a table, a file system, etc). In one example, over 100 million preset packets, each with a unique packet ID (as shown in FIG. 3), are stored in a database 400 to represent corresponding audio packets, each of which, in turn, represents about 46 milliseconds of audio. At 1020, exemplary process 1000 implements any suitable comparison algorithm that identifies similar characteristics of the preset packets that correspond to the audio stream packets. For example, a psychoacoustic matching algorithm as described below can be used. For example, block 1020 may analyze the frequency content of the preset packets and the frequency content of the audio stream packets and identify several different preset packets that match the audio stream packets. The exemplary process 1000 can then identify 20 non-harmonic frequencies of interest of the audio stream packets and determine the amplitude of each frequency. Exemplary process 1000 determines that a preset packet matches the audio stream packet if it contains each non-harmonic frequency with similar amplitudes. Other types of analysis, however, can be used to determine that the preset packets correspond to the audio stream packets. For instance, harmonics information and/or musical note information can be used to determine a match (e.g., an optimal preset packet to represent the audio stream packet and reproduce it with acceptable sound quality).

At 1025, exemplary process 1000 receives a unique packet ID for the optimal or "matched" preset packet selected for each audio stream packet. The packet ID comprises any suitable number of bits to identify each preset packet for use by exemplary process 1000 (e.g., 27 bits, 28-30 bits, etc.). At 1030, exemplary process 1000 determines a linear or non-linear transformation to apply as necessary to each matched preset packet (e.g., filtering, compression, harmonic distortion, etc.) to achieve suitable sound quality. For example, exemplary process 1000, at 1035, can compute an error vector for a linear transformation of frequency characteristics to apply to the matched preset packet.

Alternatively at 1035, exemplary process 1000 can determine parameters for the selected transformation of each matched preset packet. The selected transformation and determined parameters are selected to transform the preset packets to more closely correspond to the audio stream packets. That is, the transformation causes the audio fidelity (i.e., the time domain presentation) of the preset packet to more closely match the audio fidelity of the audio stream packets. In another example, at 1035 the exemplary process can perform an iterative match of the audio stream packets based on a prior packet or a later packet, or any combination thereof. Exemplary process 1000 then transforms each preset packet based on the selected transformation and the determined parameters to identify an optimal or matched preset packet.

Exemplary process 1000 generates a modifier code based on the selected transformation and the determined transformation parameters. For instance, the modifier code may be 19 bits to indicate the type of transformation (e.g., a filter, a gain stage, a compressor, etc.), the parameters of the transformation (e.g., Q, frequency, depth, etc.), or any other suitable information. The modifier code can also iteratively link to previous or later modifier codes of different preset packets. For instance, substantially similar low frequencies may be present over several sequential audio stream packets, and a transformation may be efficiently represented by linking to a common transformation. In another example, the modifier code may also indicate plural transformations or may be variable in length (e.g., 5 bits, 20 bits, etc).

At 1055, exemplary process 1000 transmits a packet comprising the packet ID of the matched preset packet and the modifier code to a receiving device. In another example, the packet ID of the matched audio packet and modifier code are stored in a file that substantially represents the input audio stream.

FIG. 9 illustrates an exemplary process 1200 to receive and process a reduced bit transmitted stream identifying preset packets according to an exemplary embodiment of the present invention. At 1205, exemplary process 1200 receives a transmitted stream and extracts packets therefrom (e.g., demodulate and decode a received stream to attain a baseband stream). At block 1210, exemplary process 1200 processes the received packets to extract a preset packet identifier and optionally a modifier code.

At 1215, exemplary process 1200 retrieves a locally stored preset packet that corresponds to the preset packet ID. In the example of FIG. 9, the preset packets of exemplary process 1200 are identical or substantially identical to the preset packets described in exemplary processes 900 and/or 1000.

At block 1220, exemplary process 1200 transforms the preset packet based on the extracted modifier code. In one example, exemplary process 1200 performs a linear or non-linear transformation to the preset packet such as frequency selective filter, for example. In another example, exemplary process 1200 performs an iterative transformation to the preset packet based on an earlier audio packet. For instance, a common transformation may apply to a group of frequencies common to a sequence of received packet IDs.

Following 1220, exemplary process 1200 processes the transformed audio packets into an audio stream (e.g., via a USAC decoder) and aurally presents the audio stream to a receiving user at 1225 after normal operations (e.g., buffering, equalizing, IFFT transformation, etc.). Block 1225 may include additional steps to remove artifacts which may result from stringing together audio packets with minor discontinuities, such steps including additional frequency filtering, amplitude smoothing, selective averaging, noise compensation, and so on. The continued playback of sequential audio stream reproduces the original audio stream by using the preset packets, and the resulting audio stream and the original audio stream have substantially similar audio fidelity.

Exemplary processes 900, 1000 and/or 1200 may be performed by machine readable instructions in a computer-readable medium stored in exemplary system 1100 (shown in FIG. 10 and described further below). The computer-readable medium may also include, alone or in combination with the program instructions, data files, data structures, and the like. The computer-readable medium and program instructions may be those specially designed and constructed for the purposes of the present invention, or they may be of the kind well-known and available to those having skill in the computer software arts. Examples of computer-readable media include magnetic media such as hard disks, floppy disks, and magnetic tape; optical media such as CD-ROM disks and DVD-ROM; magneto-optical media such as optical disks; and hardware devices that are specially configured to store and perform program instructions, such as read-only memory (ROM), random access memory (RAM), flash memory, and the like. The medium may also be a transmission medium such as optical or metallic lines, wave guides, and so on, including a carrier wave transmitting signals specifying the program instructions, data structures, and so on. Examples of program instructions include both machine code, such as produced by a compiler, and files containing higher level code that may be executed by the computer using an interpreter. The described hardware devices may be configured to act as one or more software modules in order to perform the operations of the above-described embodiments of the present invention.

Figure 10:
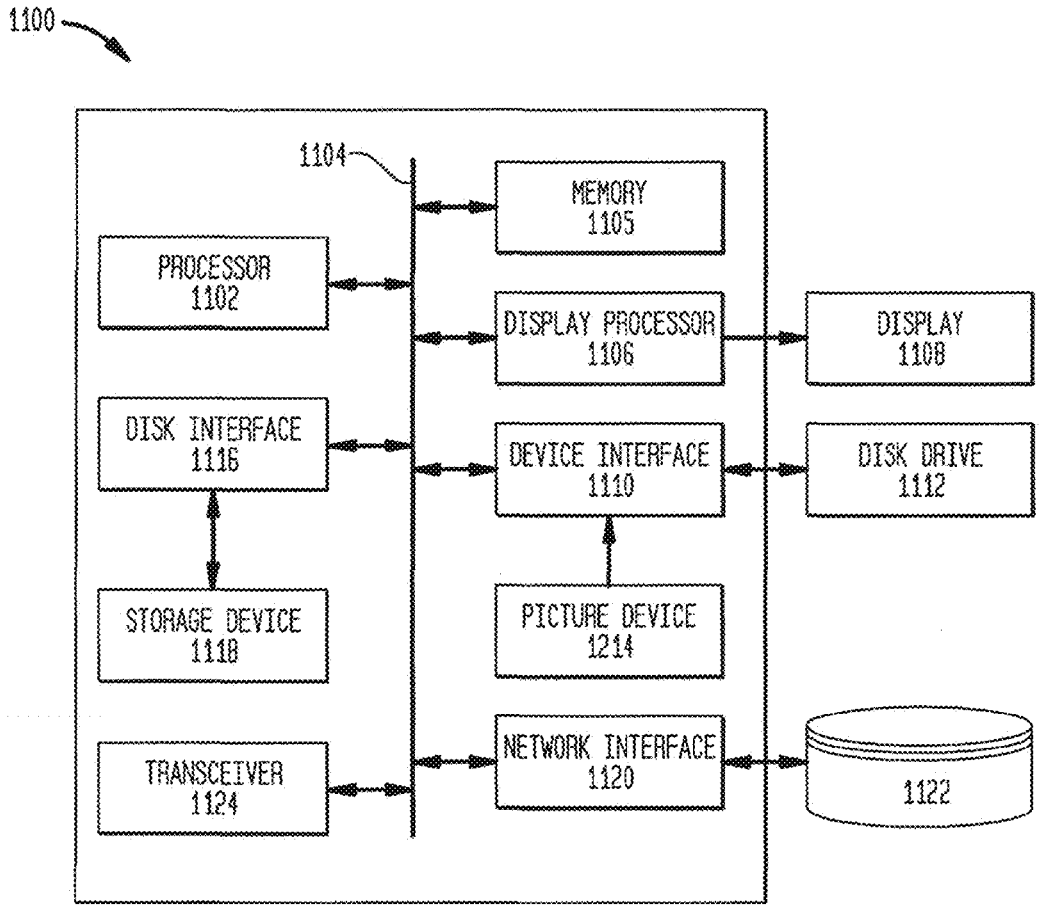
FIG. 10 depicts a block diagram of an exemplary system to implement the processes of FIGS. 7-9 according to an exemplary embodiment of the present invention.

FIG. 10 is a block diagram of system 1100 that can implement exemplary process 900 (database generation) or exemplary process 1000 (encoding audio stream using preset packet IDs and modifiers). Generally, system 1100 includes a processor 1102 that can perform general logic and/or mathematical instructions (e.g., hardware instructions such as RISC, CISC, etc.). Processor 1102 includes internal memory devices such as registers and local caches (e.g., L2 cache) for efficient processing of instructions and data. Processor 1102 communicates within system 1100 via bus interface 1104 to interface with other hardware such as memory 1105. Memory 1105 may be a volatile storage medium (e.g., SRAM, DRAM, etc.) or a non-volatile storage medium (e.g., FLASH, EPROM, EEPROM, etc.) for storing instructions, parameters, and other relevant information for use by processor 1102.

Processor 1102 also communicates with a display processor 1106 (e.g., a graphic processor unit, etc.) to send and receive graphics information to allow display 1108 to present graphical information to a user. Processor 1102 also sends and receives instructions and data to device interface 1110 (e.g., a serial bus, a parallel bus, USB™, Firewire™, etc.) that communicates using a protocol to internal and external devices and other similar electronic devices. For instance, exemplary device interface 1110 communicates with disk drive 1112 (e.g., CD-ROM, DVD-ROM, etc.), image sensor 1114 that receives and digitizes external image information (e.g., a CCD or CMOS image sensor), and other electronic devices (e.g., a cellular phone, musical equipment, manufacturing equipment, etc.).

Figure 11:
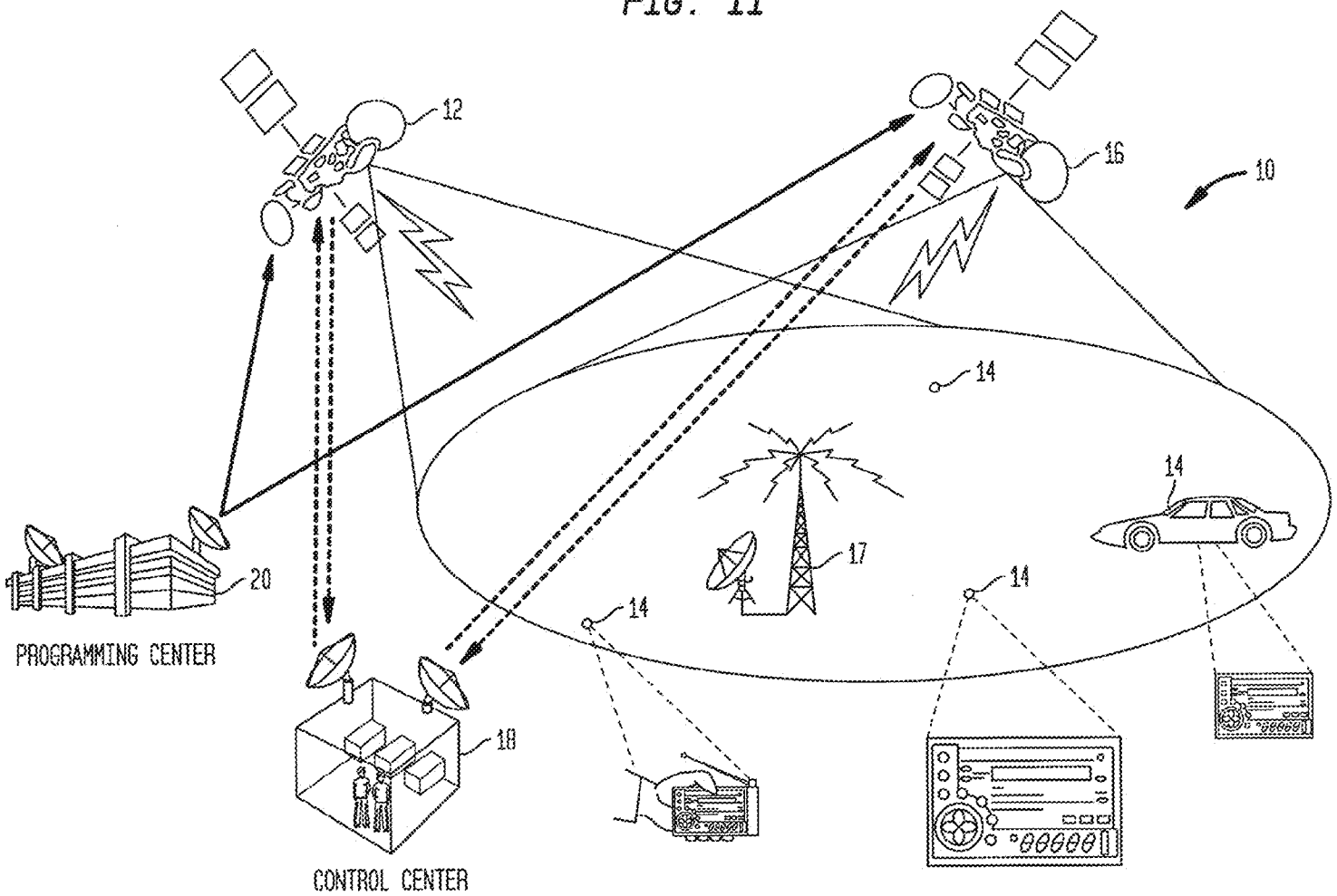
FIG. 11 depicts an exemplary content delivery system for increasing transmission bandwidth using preset packets according to an exemplary embodiment of the present invention.

Disk interface 1116 (e.g., ATAPI, IDE, etc.) allows processor 1102 to communicate with other storage devices 1118 such as floppy disk drives, hard disk drives, and redundant array of independent disks (RAID) in the system 1100. In the example of FIG. 11, processor 1102 also communicates with network interface 1120 that interfaces with other network resources such as a local area network (LAN), a wide area network (WAN), the Internet, and so forth. For instance, FIG. 11 illustrates network interface 1120 interfacing with a relational database 1122 that stores information for retrieval and operation by the system 1100. Exemplary system 1100 also communicates with other wireless communication services (e.g., 3GPP, 802.11(n) wireless networks, Bluetooth™, etc.) via transceiver 1124. In another example, transceiver 1124 communicates with wireless communication services via device interface 1110.

Exemplary embodiments of the present invention are next described with respect to a satellite digital audio radio service (SDARS) that is transmitted to receivers by one or more satellites and/or terrestrial repeaters. The advantages of the methods and systems for improved transmission bandwidth described herein and in accordance with illustrative embodiments of the present invention can be achieved in other broadcast delivery systems (e.g., other digital audio broadcast (DAB) systems, digital video broadcast systems, or high definition (HD) radio systems), as well as other wireless or wired methods for content transmission such as streaming. Further, the advantages of the described examples can be achieved by user devices other than radio receivers (e.g., internet protocol applications, etc.).

By way of an example, exemplary process 1000, as shown in FIG. 8, and exemplary system 1100, as shown in FIG. 10, can, for example, be provided at programming center 20 in an SDARS system as depicted in FIG. 11. More specifically, FIG. 11 depicts exemplary satellite broadcast system 10 which comprises at least one geostationary satellite 12 for line of sight (LOS) satellite signal reception at least one receiver indicated generally at reference numeral 14. Satellite broadcast system 10 can be used for transmitting at least one source stream (e.g., that provides SDARS) to receivers 14. Another geostationary satellite 16 at a different orbital position is provided for diversity purposes. One or more terrestrial repeaters 17 can be provided to repeat satellite signals from one of the satellites in geographic areas where LOS reception is obscured by tall buildings, hills and other obstructions. Any different number of satellites can be used and satellites any type of orbit can be used. It is to be understood that the SDARS stream can also be delivered to computing devices via streaming, among other delivery or transmission methods.

As illustrated in FIG. 11, receiver 14 can be configured for a combination of stationary use (e.g., on a subscriber's premises) and/or mobile use (e.g., portable use or mobile use in a vehicle). Control center 18 provides telemetry, tracking and control of satellites 12 and 16. The programming center 20 generates and transmits a composite data stream via satellites 12 and 16, repeaters 17 and/or communications systems providing streaming to user's receivers or computing devices. The composite data stream can comprise a plurality of payload channels and auxiliary information as shown in FIG. 12.

Figure 12:
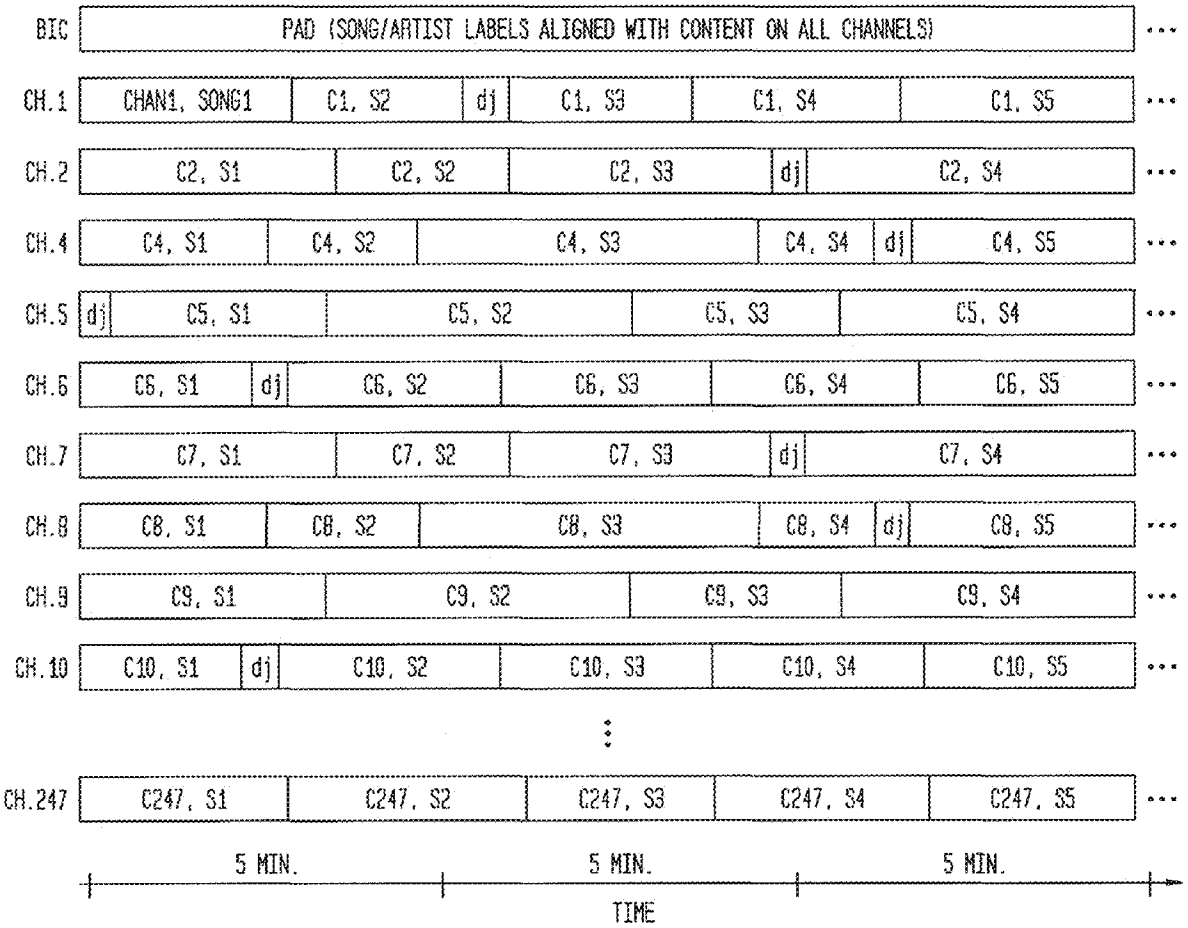
FIG. 12 illustrates an exemplary audio content stream for use with the system of FIG. 11.

More specifically, FIG. 12 illustrates different service transmission channels (e.g., Ch. 1 through Ch. 247) providing the payload content and a Broadcast Information Channel (BIC) providing the auxiliary information in the SDARS. These channels are multiplexed and transmitted in the composite data stream transmitted to receiver 14.

In the example of FIG. 11, programming center 20 can, for example, obtain content from different information sources and providers and provide the content to corresponding encoders. The content can comprise, for example, both analog and digital information such as audio, video, data, program label information, auxiliary information, etc. For example, programming center 20 can provide SDARS generally having at least 100 different audio program channels to transmit different types of music programs (e.g., jazz, classical, rock, religious, country, etc.) and news programs (e.g., regional, national, political, financial, sports etc.). The SDARS also provides and relevant information to users such as emergency information, travel advisory information, and educational programs, for example.

In any event, the content for the service transmission channels in the composite data stream is digitized, compressed and the resulting audio packets compared to database 400 to determine matching preset packets and modifiers as needed to transmit the audio packets in a reduced bit format (i.e., as packet IDs and Modifiers) in accordance with illustrative embodiments of the present invention. The reduced bit format can be employed with only a subset of the service transmission channels to allow legacy receivers to receive the SDARS stream, while allowing receivers implementing process 1200 (FIG. 9), for example, to demodulate and decode the received channels employing the reduced bit format described in connection with FIG. 8. Receivers can also be configured, for example, to receive both legacy channels and reduced bit format (Efficient Bandwidth Transmission or "EBT") channels so that programming need not be duplicated on both types of channel.

In addition, it is to be understood that there could be many more channels (e.g., hundreds of channels); that the channels can be broadcast, multicast, or unicast to receiver 14; that the channels can be transmitted over satellite, a terrestrial wireless system (FM, HD Radio, etc.), over a cable TV carrier, streamed over an internet, cellular or dedicated IP connection; and that the content of the channels could include any assortment of music, news, talk radio, traffic/weather reports, comedy shows, live sports events, commercial announcements and advertisements, etc. "Broadcast channel" herein is understood to refer to any of the methods described above or similar methods used to convey content for a channel to a receiving product or device.

Figure 13:
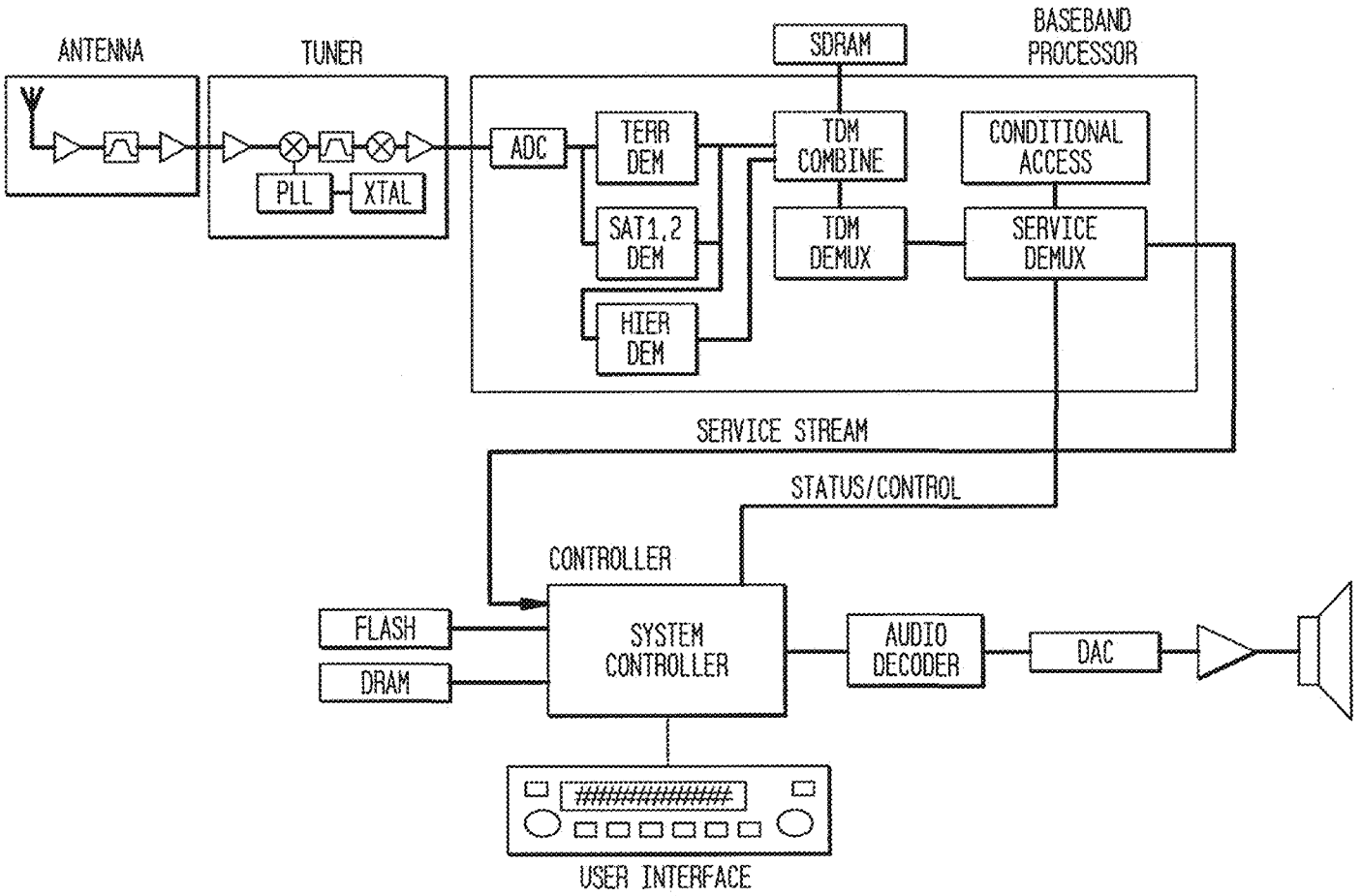
FIG. 13 illustrates an exemplary receiver for use with the system of FIG. 11.

FIG. 13 illustrates exemplary receiver 14 for SDARS that can implement exemplary receive and decode process 1200. In the example of FIG. 13, receiver 14 comprises an antenna, tuner and receiver arms for processing the SDARS broadcast stream received from at least one of satellites 12 and 16, terrestrial repeater 17, and optionally a hierarchical modulated stream, as indicated by the demodulators. These received streams are demodulated, combined and decoded via the signal combiner in combination with the SDARS, and de-multiplexed to recover channels from the SDARS broadcast stream, as indicated by the signal combining module and service demultiplexer module. Processing of a received SDARS broadcast stream is described in further detail in commonly owned U.S. Pat. Nos. 6,154,452 and 6,229,824, the entire contents of which are hereby incorporated herein by reference. A conditional access module can optionally be provided to restrict access to certain demultiplexed channels. For example, each receiver 14 in an SDARS system can be provided with a unique identifier allowing for the capability of individually addressing each receiver 14 over-the-air to facilitate conditional access such as enabling or disabling services, or providing custom applications such as individual data services or group data services. The de-multiplexed service data stream is provided to the system controller.

The system controller in radio receiver 14 is connected to memory (e.g., Flash, SRAM, DRAM, etc.), a user interface, and at least one audio decoder. Storage of the local file tables at receiver 14, for example, can be in Flash memory, ROM, a hard drive or any other suitable volatile or non-volatile memory. In one example, a 8 GB NAND Flash device may store database 400 of preset packets. In the example of FIG. 13, the preset packets stored in receiver 14 are identical or substantially identical to the preset packets stored in exemplary processes 900 and/or 1000. The system controller in conjunction with database 400 can process packets in the demodulated, decoded and de-multiplexed channel streams to extract the packet IDs and modifiers and aurally represent the transformed audio packets as described above in connection with exemplary process 1200 (FIG. 9).

More specifically, as described above, the preset packets may be locally stored in the flash memory. Upon receipt of an exemplary 1 kbps packet stream comprising a packet IDs for respective preset packets stored in the flash memory and any corresponding modifier codes, receiver 14 retrieves the preset packets corresponding to the packet IDs and transforms them into a 24 kbps USAC stream based on the information in the modifier code. Receiver 14 then performs any suitable processing (e.g., buffering, equalization) and decoding, amplifies the audio stream, and aurally presents the audio stream to a user of receiver 14.

Exemplary process 1200 allows a device to receive a broadcast stream having packet ID and modification information. Exemplary process 1200 retrieves the locally stored preset packets based on packet ID information and transforms the preset packets based on the received modification information to more accurately correspond to the original audio stream. In one example, the packet ID for a 46 millisecond preset packet is represented by 27 bits and the modification information is represented by 19 bits. Thus, the exemplary process 1200 allows recombination of the locally stored preset packets to substantially reproduce a 24 kbps USAC audio stream.

In another exemplary process, the audio packets can be apportioned based on frequency content to emphasize particular audio. For instance, higher frequencies that are not easily perceivable to a listener could be removed or substantially reduced in quality (e.g., lower sampling rate, lower sample resolution, etc) and content lower frequencies that are more prevalent could be increased (e.g., higher sampling rate, higher sample resolution, etc.). As an example, an audio source comprising mostly human speech (e.g., talk radio, sports broadcasts, etc.) generally requires a sampling rate of 8 kilohertz (kHz) to substantially reproduce human speech. Further, human speech typically has a fundamental frequency from 85 Hz to 255 Hz. In such an example, frequencies below 300 Hz may have increased bit depth (e.g., 16 bits) to allow more accurate reproduction of the fundamental frequency to increase audio fidelity of the reproduced audio source.

In the examples described above, a receiver of the broadcast system can, for example, store synthetic preset packets that can be later transformed to allow reception of low bandwidth audio streams. For example, in some exemplary embodiments, a 1 kbps stream can be sufficient to reproduce a 24 kbps USAC audio stream with a minimal loss in audio fidelity. Such an audio stream can, for example, be from either a prerecorded source (e.g., a pre-recorded MP3 file) or from a live recorded source such as a live broadcast of a sports event.

In exemplary embodiments of the present invention, in order to implement the processes described above, a "dictionary" or "database" of audio "elements" can be created, and a coder-decoder, or "codec" can be built, which can, for example, use the dictionary or database to analyze an arbitrary audio file into its component elements, and then send a list of such elements for each audio file (or portion thereof) to a receiver. In turn, the receiver can pull the elements from its dictionary or database of audio "elements". Such an exemplary codec and its use is next described, based upon an exemplary system built by the present inventors.

Exemplary EBT Codec

In exemplary embodiments of the present invention, an Efficient Bandwidth Transmission codec ("EBT Codec") can be targeted to leverage the availability of economical receiver memory and modern signal processing algorithms to achieve extremely low bit rate, and high quality, music coding. Using, for example, from 8-24 GB of receiver memory, and using coding templates derived from a large database of 20,000+ songs, music coding rates approaching 1-2 kbps can be achieved. The encoded bit stream can include a sequence of code words and modifier pairs, as noted above, each corresponding to an audio frame (typically 25-50 msec) of the audio clip in question. The codeword in the pair can be an index into a large template dictionary or database stored on the receiver, and the modifier can be, for example, adaptive frame specific information used for improving a perceptual match of the template matching the codeword to the original audio frame.

Figure 14:
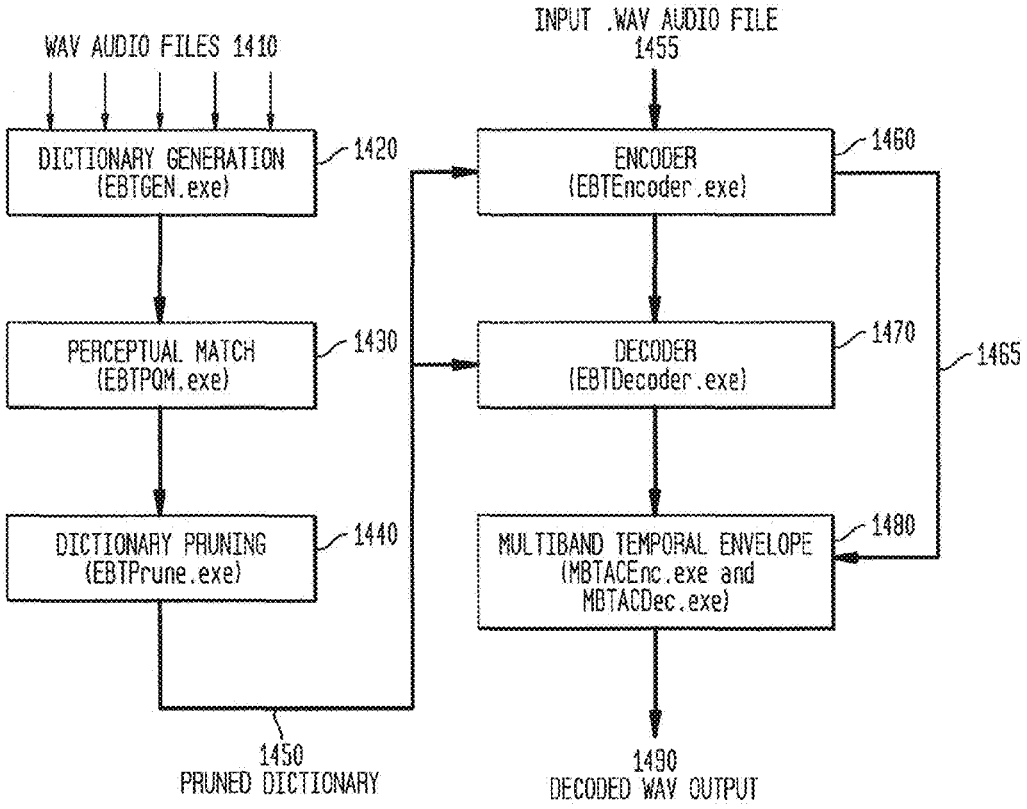
FIG. 14 is a high level process flow chart for exemplary dictionary generation and an exemplary codec according to an exemplary embodiment of the present invention.

FIG. 14 depicts a high level process flow chart for an exemplary complete EBT Codec according to an exemplary embodiment of the present invention. FIG. 14 refers to exemplary ".exe" files (shown in parenthesis). The source code of some of which is provided in Exhibit A, and which are also described below. FIG. 14 actually illustrates two processes: (i) building of a dictionary of codewords, and (ii) using such a dictionary, once created, to encode and decode generic audio files. First the dictionary creation aspect will be described (as noted above, this refers to the creation of a database of preset packets or codewords). With reference to FIG. 14, at 1410, .wav audio files can be input into dictionary generation stage 1420. It is noted that the input audio files can have, for example, a bit depth of 16 bits, and a 44.1 KHz sample rate, as is the case for CD digital audio files. From dictionary generation stage 1420 process flow moves to perceptual matching stage at 1430. From there, the dictionary can be pruned to remove redundant codewords, or, for example, codewords that are sufficiently similar such that only one of them is needed, given the use of modifiers, as noted above. The pruned dictionary can be then used by the codec to analyze on the transmit end, as well as synthesize on the receiver end, any audio file. The degree of pruning, in general, is a parameter that will be system specific. Obviously, greater pruning makes the number of codewords or preset packets in the database smaller, requiring less memory. The tradeoff is that less preset packets in the database require a less accurate perceptual matching of the decoded signal to the original, or more and more complex modifications to be performed on the receiver side in order to keep the perceptual match close, even when using a less similar preset packet.

Once created, pruned dictionary 1450 can be, for example, made available to both the encoder and decoder, as shown. To encode an arbitrary audio clip, a .wav file of the clip is input to the encoder at 1460, which, using the pruned dictionary, finds dictionary entries best matching the frames of the audio clip, the best match being in the sense of a human perceptual match using various defined metrics. There are various ways of going about such perceptual matching, as explained in greater detail below. Once obtained, this list of IDs for the identified codewords is transmitted over a broadcast stream to decoder at 1470, which then assembles the identified codewords, and modifies or transforms them as may be directed, to create a sequence of compressed audio packets best matching the original audio .wav file, given (i) the available fidelity from the pruned dictionary, and based upon (ii) the perceptual matching algorithms being used. At this stage the sequence of compressed audio packets may be decompressed and played. However, after decoding at 1470, there is another process, which operates as a check of sorts on the fidelity of the reproduction. This can be, for example, the Multiband Temporal Envelope processing at 1480. This processing modifies the envelope of the generated audio file at the previous step 1470 as per the envelope of the original audio file (the input audio file 1455 to encoder). Following Multiband Temporal Envelope processing at 1480, a decoded .wav output file is generated at 1490. The Multiband Temporal Envelope processing can be instructed, by way of the modification instructions sent by the encoder, or, alternatively, it can be launched independently on the receiver, operating on the sequence of audio frames as actually created.

As noted above, as can be seen in FIG. 14, in each box representing a stage in the processing, an executable program or module is listed. These refer to exemplary programs created as an exemplary implementation of the dictionary generation and codec of FIG. 14. Exemplary EBTDecoder and EBTEncoder modules are provided in Exhibit A below. In what follows, a brief description of each such module shown in FIG. 14 is provided.

A. Dictionary Generation Modules

EBTGEN (Dictionary Generation)

Syntax:

EBTGEN.exe -g genre Inputwav_filename.wav

Description:

All the files (or frames) in the dictionary can be named with a numerical value. New frames can easily be added for any new audio file where the name of new file can be started from the last numerical value file already stored in the database. For this, a separate file "ebtlastfilename.txt" can, for example, be used, which can, for example, have the last numerical value.

EBTPQM (Perceptual Match)

Syntax:

EBTPQM.exe -srf 1 -lrf 100 -sef 1 -lef 34567 -path "database!"

where,

-srf: Starting reference frame to compare with all other dictionary frame.

-lrf: Last reference frame to compare with all other dictionary frame.

-sef: Starting dictionary frame to be compared with a reference frame.

-lef: Last dictionary frame to be compared with a reference frame.

-path: Initial dictionary path.

Description:

This module can pick frames in an input file one by one and discover the best perceptually matching frame within the rest of the dictionary frames. The code can generate a text file called "mindist.txt", which can have, for example:

Reference frame file name, frame which is compared with all other frames;

Best matched frame file name frame found to be best matched within the dictionary;

Quality index. (lies from 1 to 5, where 1 corresponds to best quality).

Inasmuch as there can be a large number of files in the dictionary, the code can perform operations at multiple servers. After execution there can then, for example, be multiple "mindist.txt" files, which can be joined into a single file, again named, for example, "mindist.txt".

EBTPRUNE (Dictionary Pruning)

Syntax:

EBTPRUNE.exe -ipath "mindist_database.txt"-dbpath "database!"

where,

-ipath: Output file of EBTPQM executable(mindist.txt).

-dbpath: Dictionary path.

Description:

This module can, for example, prunes the best matching frames from the dictionary. For example, it can be used to prune frames having a counterpart frame in the dictionary with a very high quality index of, say from 1 to 1.4, for example. The pruning limit can, for example, be set percentage-wise as well. Thus, for example, assuming 10% pruning, the module can first sort all of the frames in the dictionary as per their quality indices from 1 to 5, and then prune the top 10% frames.

B. Codec Modules

EBTENCODER

Syntax:

EBTENCODER.exe -if input_filename.wav -dbpath "database!"-nfile 1453 -of "encoded.enc" -h 0 where,

-if: Input wav file

-dbpath: Pruned dictionary path.

-nfile: Total number of files in the initial dictionary.

-of: Encoder output filename

-h: harmonic analysis flag

Description:

This module encodes an audio file using the pruned dictionary. The best matched frame from the dictionary is obtained for each frame of the input audio file, and the other relevant parameters to reconstruct the audio at decoder side can be computed. The encoder bit stream can, for example, have the following information per frame:

Index (filename) of the frame in the dictionary.

RMS value of the original frame.

Harmonic flag if we reconstruct the phase from the previous frame phase information.

Cross-correlation based time-alignment distance.

It can also generate an audio file which is required for MBTAC operation (shown at 1480 in FIG. 14) called, for example, "EBTOriginal.wav".

EBTDECODER

Syntax:

EBTDECODER.exe -ipath "encoded.ebtenc" -dbpath "database/" -of "EBTdecoded_carr.wav"

where,

-ipath: Encoded file.

-dbpath: Pruned dictionary path.

-of: EBTDecoder output which will be passed to MBTAC Encoder.

Description:

Decodes the encoded bit stream with the help of pruned dictionary and reconstructs audio signal.

EBTMBTAC (Multiband Temporal Envelope)

Syntax:

MBTACEnc.exe -D 10 -r 2 -b 128 EBTOriginal.wav EBT2Sample_temp.aac EBTdecoded_carr.wav MBTACDec.exe -if EBT2Sample_temp.aac -of EBT2_DecodedOut.wav where, EBTOriginal.wav: EBTENCODER output wave file.

EBT2Sample_temp.aac: Temporary file required for MBTACDec.exe

EBTdecoded_carr.wav: MBTACEnc.exe output wave file.

EBT2_DecodedOut.wav: Final decoded output

Description:

Modifies the envelope of an audio file generated at the previous step (EBTDECODER.exe), as per the envelope of the original audio file (input audio file 1455). Outputs the final decoded audio file.

(end of exemplary module description)

*****

Figure 15:
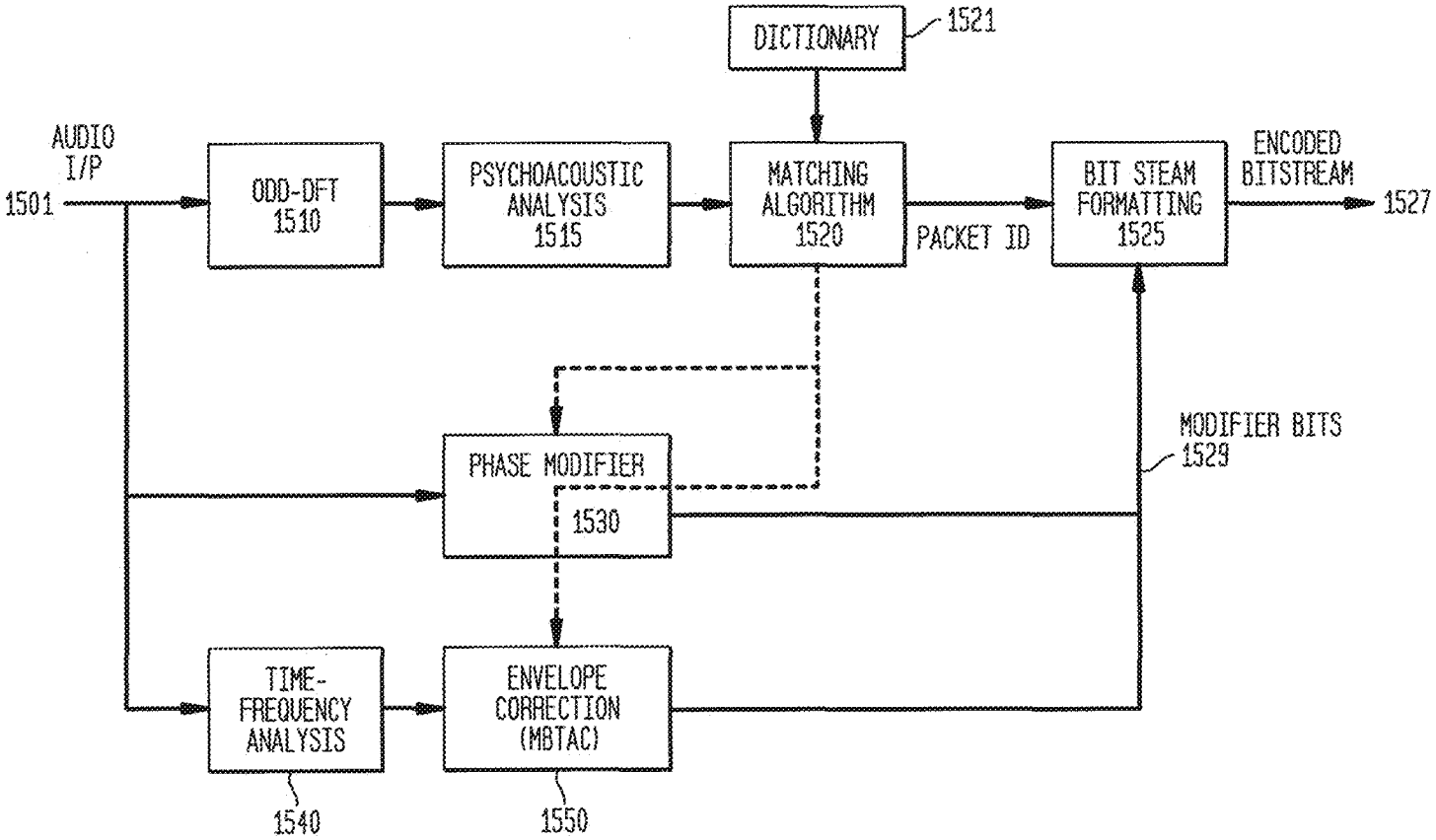
FIG. 15 is a process flow chart for an exemplary encoder according to an exemplary embodiment of the present invention.
Figure 16:
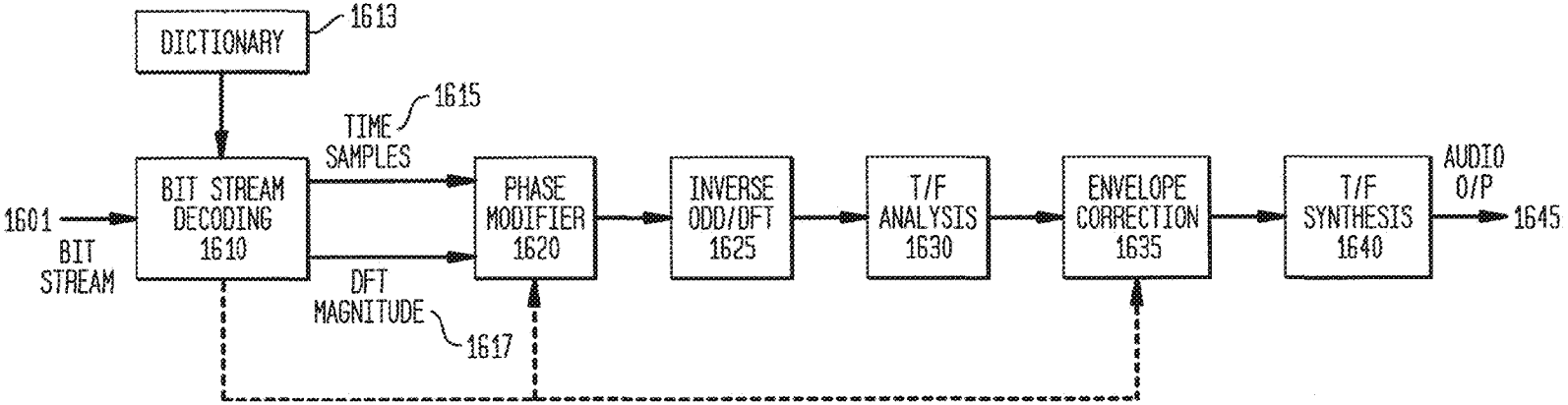
FIG. 16 is a process flow chart for an exemplary decoder according to an exemplary embodiment of the present invention.

Next described are FIGS. 15-16, which provide further details of an exemplary encoder and decoder according to exemplary embodiments of the present invention. As noted above, the encoder and decoder were each presented as single processing stages in FIG. 14. FIGS. 15-16 now provide the details of this processing.

It is noted that exemplary embodiments of the present invention utilize a DFT based coding scheme where normalized DFT magnitude can be obtained from the dictionary which is perceptually matched with an original signal, and the phase of neighboring frames can be either aligned, for example, or generated analytically in a separate stage. Afterwards, envelope correction can be applied over a time-frequency plane.

FIG. 15 depicts an exemplary process flow chart for an exemplary encoder. With reference thereto, at 1501, an audio file can be input to the ODD-DFT stage 1510. This refers to an Odd Frequency Discrete Fourier Transform Stage. From 1510 process flow moves to a psychoacoustic analysis module at 1515, and from there to the matching algorithm at 1520, which seeks a best match for a given frame from a dictionary. Thus, matching algorithm 1520 has access to the complete dictionary 1521. From matching algorithm 1520, a packet ID is output. This identifies a packet in the dictionary which best matches the frame being encoded. This can be fed, for example, to bit stream formatting stage 1525 that outputs encoded bit stream 1527. Meanwhile, shown at the bottom of FIG. 15 is a parallel processing leg, where the audio input 1501 is also fed to each of Phase Modifier 1530 and Time Frequency Analysis 1540. Moreover, (i) the output of Phase Modifier 1530, as well as (ii) the output of Envelope Correction 1550 is also input to Bit Stream Formatting 1525 as Modifier Bits 1529. It is noted that Time Frequency Analysis 1540 and the related Envelope Correction 1550 are equivalent to the Multiband Temporal Envelope Processing 1480 of FIG. 14.

The dotted lines running from Matching Algorithm 1520 to each of Phase Modifier 1530 and MBTAC 1550 indicate respectively the phase and envelope information of the matched dictionary entry (codeword) which is provided to corresponding blocks 1530 and 1550. So, for example, the match is based on spectral magnitude but the dictionary (database) also stores the phase and magnitude of the corresponding audio segment/frame, to use in determining the modifier bits.

Similarly, FIG. 16 is a detailed process flow chart for an exemplary decoder. With reference thereto, at 1601 a received bit stream, such as bit stream 1527 output from the encoder, as described above with reference to FIG. 15, is input to bit stream decoding 1610. Bit stream decoding 1610 further has access to dictionary 1613, created as described above in connection with FIG. 14. From bit stream decoding both time samples 1615, and DFT magnitude 1617, are output. These are then both fed into phase modifier 1620, whose output is then fed into inverse ODD-DFT 1625. The output of ODD-DFT 1625 is then, for example, fed into Time/Frequency analysis 1630, whose output can then be fed to Envelope Correction 1635. At the same time, as noted above with reference to FIG. 14, from 1635 the processing moves to Time Frequency Synthesis 1640, from which an audio output file 1645 is generated, which can then be used to drive a speaker and play the reconstructed audio aloud to a user. In addition, bit stream decoding also provides signal information to Phase Modifier 1620 and Envelope Correction 1635, as shown by the dotted lines and described further below.

Next described, are various additional details regarding some of the building blocks of the encoder and decoder algorithms.

Psychoacoustic Analysis:

As noted above, the encoder utilizes psychoacoustic analysis following DFT processing of the input signal and prior to attempting to find a best matching codeword from the dictionary. In exemplary embodiments of the present invention, the psychoacoustic techniques described in U.S.

Pat. No. 7,953,605 can be used, or, for example, other known techniques, as may be known in the art.

Phase Modification Algorithm:

Psychoacoustic analysis identifies the best matched frequency pattern as per human perception constraints, based on psycho-physics. During the reconstruction of audio, neighborhood segments should be properly phase aligned. Thus, in exemplary embodiments of the present invention, two methods can be used for phase alignment between the segments: (1) cross correlation based time alignment, which can be used at onset frames indicative of the start of a new harmonic pattern; and (2) phase continuity between harmonic signals, which can be used at all subsequent frames as long as a harmonic pattern persists.

Cross Correlation Based Time Alignment:

In exemplary embodiments of the present invention this technique can be used to time align the frame obtained from the dictionary as best matching the original frame for that particular N sample segment. For example, cross correlation coefficients can be evaluated between these two frames, and the instant having the highest correlation value can be selected as the best time aligned. Thus, $$R[n] = \sum_{\tau=0}^{N-1} x_d[\tau] * x_o[n-\tau]$$

Where, n goes from −(N−1) to (N−1).

And the best time aligned instant m, $$=\max\{R[n]\}$$

It is noted that here the database segment has been shifted by m samples, and the rest of the samples have been filled with zeros. To take care of this discontinuity between the segments, in exemplary embodiments of the present invention adaptive power complimentary windows can be used, as shown in FIG. 17.

Figure 17:
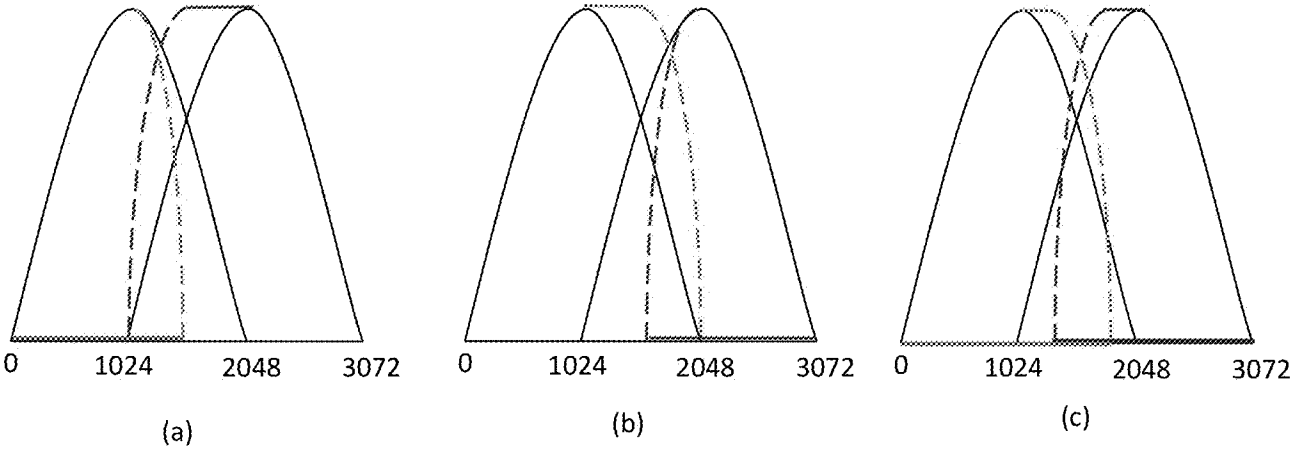
FIG. 17 illustrates adaptive power complementary windows, used in an exemplary cross correlation based time alignment technique according to an exemplary embodiment of the present invention.

As shown in FIG. 17, generally all segments can at first be windowed with power complimentary sine window, and overlapped with neighborhood segments by N/2 samples during reconstruction. Sine windows are shown in FIG. 17 in solid black lines. During the exemplary time alignment method, if one segment is shifted left by an amount m, as shown in blue in FIG. 17(*a*), the samples from (N−m+1) to N can be filled with zeros. To maintain this discontinuity, during reconstruction, the next segment data for 0 to N/2 can be windowed by an adaptive sine window, shown in FIG. 17(*a*) in red. The blue and red windows should satisfy the power complimentary nature. Likewise, FIGS. 17(*b*) and 17(*c*) show the other possible cases during the time alignment method.

Phase Continuity Between Harmonic Signals

In exemplary embodiments of the present invention, the phase of harmonic signals continuing for more than one segment can be computed analytically. Thus, the phase of the very next segment can be guessed rather accurately. For example, suppose that a complex exponential tone at frequency f is continuing for more than one segment. All of the segments are overlapped with other segments by 1024 samples. So it is necessary to compute the relation between the signal started from $n^{th}$ sample and the signal at the $(n+1024)^{th}$ instant.

As is known, a signal in the time or continuous domain can be represented as:

$$x(t)=\exp(j2\pi ft)$$

and in the discrete domain as:

$$x[n]=\exp\ (j2\pi fn/f_s),$$

where, $f_s$ is the sampling frequency. If the whole frequency bandwidth is represented by N/2 discrete points, (k+Δf) represents the digital equivalent frequency f, where k is an integer and Δf is the fractional part of digital frequency.

$$x[n] = \exp\left(j2\pi\left(\frac{k+\Delta f}{N}\right)n\right).$$

Now, a harmonic signal at N/2 instant can be written as, $$\begin{aligned} x[n+N/2] &= \exp\left(j2\pi\left(\frac{k+\Delta f}{N}\right)(n+N/2)\right) \\ &= \exp\left(j\pi(k+\Delta f) + j2\pi\left(\frac{k+\Delta f}{N}\right)n\right) \\ &= x[n]\exp(j\pi(k+\Delta f)). \end{aligned}$$

The above equation shows that signals at both these instances differ by phase of π(k+Δf), and the same is applicable in the frequency domain. Thus, for a real world signal such as, for example, an audio signal having multiple tones continuing for more than one segment, the phase can be easily calculated at the tonal bins using the above information. The only prerequisite is the accurate identification of frequency components present in any signal.

Having the phase information at tonal bins, it is noted that the phase at other non-tonal bins also plays an important role, which has been observed through experiments. In one exemplary approach, linear interpolation between the tonal bins can be performed to compute the phase at non-tonal bins, as shown in FIG. 18.

Figure 18:
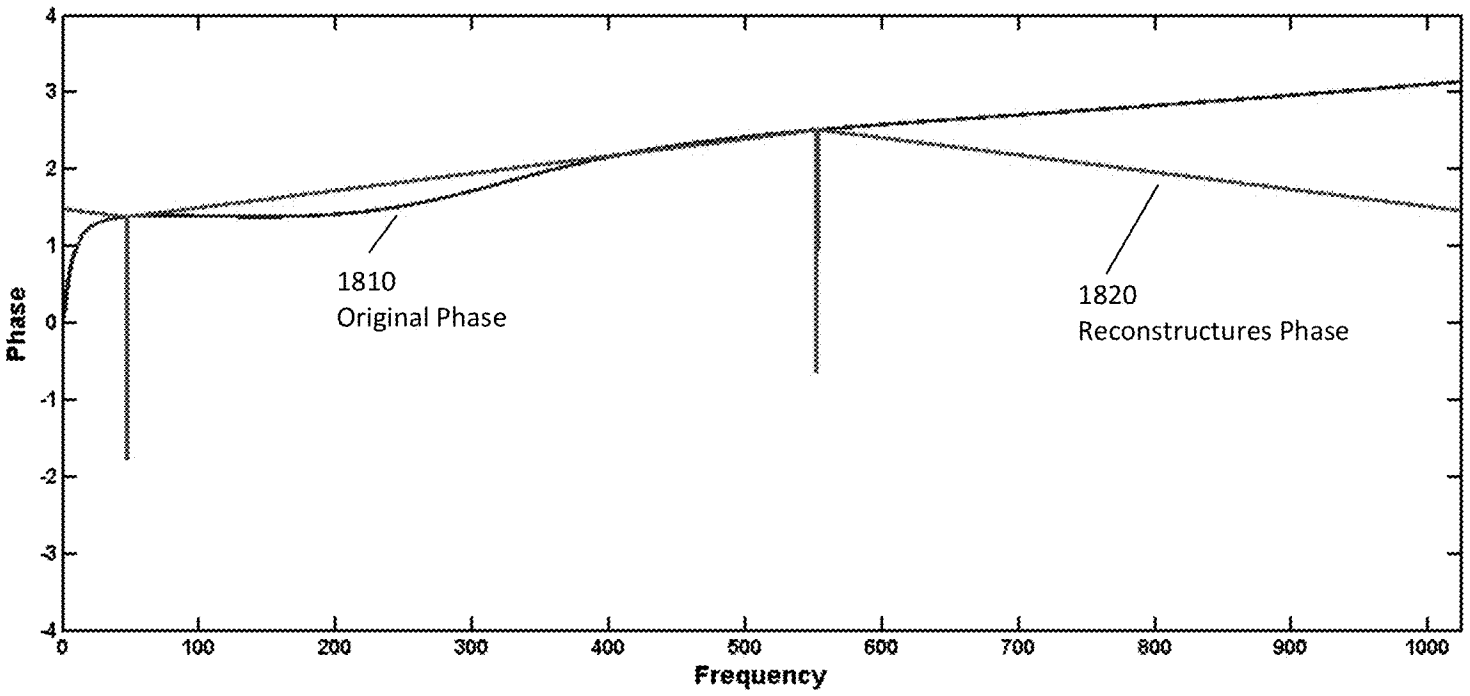
FIG. 18 illustrates linear interpolation of phase between tonal bins to compute phase at non-tonal bins according to an exemplary embodiment of the present invention.

Thus, FIG. 18 shows the phase of an N sample segment where the blue colored line 1810 shows the original phase, and the red colored line 1820 shows the reconstructed phase obtained by using analytical results and the linear interpolation method. The signal consists of two tones, at frequencies 1 Khz and 11.882 KHz, or equivalently in the digital domain (k+Δf), these tone values are 46.44 and 551.8. After DFT analysis, the magnitude frequency response has peaks at the $46^{th}$ bin and the $551^{th}$ bin and the phase response has a jump of π (pi) radians at these bins corresponding to the two tones.

Although the above calculation has been done only for one complex tone signal, it was observed that the above results hold very accurately at all tonal positions in a given signal. Therefore, in the above example, having two tones, the phase at tonal bins can be predicted once the exact frequencies present in the signal are known, i.e., the (k+Δf) values. Once the two phase values at these two bins are known, phase at other bins can be produced using linear interpolation between these two bins, as seen in red line 1820 in FIG. 18.

It was further observed that linear interpolation is not always a very accurate method for predicting the phase in between the tonal bins. Thus, in exemplary embodiments of the present invention, other variants for interpolation can be used, such as, for example, simple quadratic, or through some analytical forms. The shape of phase between the bins will also depend on the magnitude strength at these tonal bins, and as well on separation between the tonal bins. The phase wrapping issue between the two tonal bins in the original segment phase response can also be used to calculate the phase between bins.

In exemplary embodiments of the present invention, a complete phase modification algorithm can, for example, use both the above described method as per the characteristic of the audio segments. Wherever harmonic signals sustained for more than one segment, the analytical phase computation method can be used, and the rest of the segments can be time aligned, for example, using the cross-correlation based method.

Codec Dictionary Generation

As noted above, the codeword dictionary (or "preset packet database") consists of unique audio segments and their relevant information collected from a large number of audio samples from different genres and synthetic signals. In exemplary embodiments of the present invention, the following steps can, for example, be performed to generate, such a database:

(1) A full length audio clip can be sampled at 44.1 KHz, and divided into small segments of 2048 samples. Each such segment can be overlapped with their neighboring segments by 1024 samples.

(2) An Odd Discrete Frequency Transform (ODFT) can be calculated for each RMS normalized time domain segments windowed with Sine window.

(3) A psychoacoustic analysis can be performed over each segment to calculate masking thresholds corresponding to 21 quality indexes varying from 1 to 5 with a step size of 0.2.

(4) Pruning: each segment has been analyzed with other segments present in the database to identify the uniqueness of the segment. Considering the new segment as an examine frame, and rest of the segments present already in the database as a reference frame, the examine frame can be allocated a quality index as per the matching criteria. An exemplary quality index can have "1" as the best match and thereafter increments of 1.2, 1.4, 1.6, etc., with a step size of 0.2 to differentiate the frames.

In exemplary embodiments of the present invention, matching criteria are, for example, based on the signal to mask ratio (SMR) between the signal energy of examine frame and the masking thresholds of the reference frame. An SMR calculation can be started using masking threshold corresponding to quality index "1" and then subsequently for increasing indexes. The above calculation satisfying SMR ratio less than one for a particular quality index, can be considered as a best match between the examine frame and reference frame.

After analyzing the new segment with all reference frames, only one segment need be kept, i.e., either the examine segment or the reference segments if both segments are found to be closely matched (based on the best match quality indexes). Or, if the examine frame is found to be unique (based on the worst match quality indexes), it can be added to the database as a new codeword entry in the dictionary.

In exemplary embodiments of the present invention, a segment can be stored in the dictionary with, for example, the following information: (i) RMS normalized time domain 2048 samples of the segment; (ii) 2048-ODFT of the sine windowed RMS normalized time domain data; (iii) Masking Threshold targets corresponding to 21 quality indexes; (iv) Energy of 1024 ODFT bins (required for fast computation); and (v) Other basic information like genre(s) and sample rate.

Figure 19:
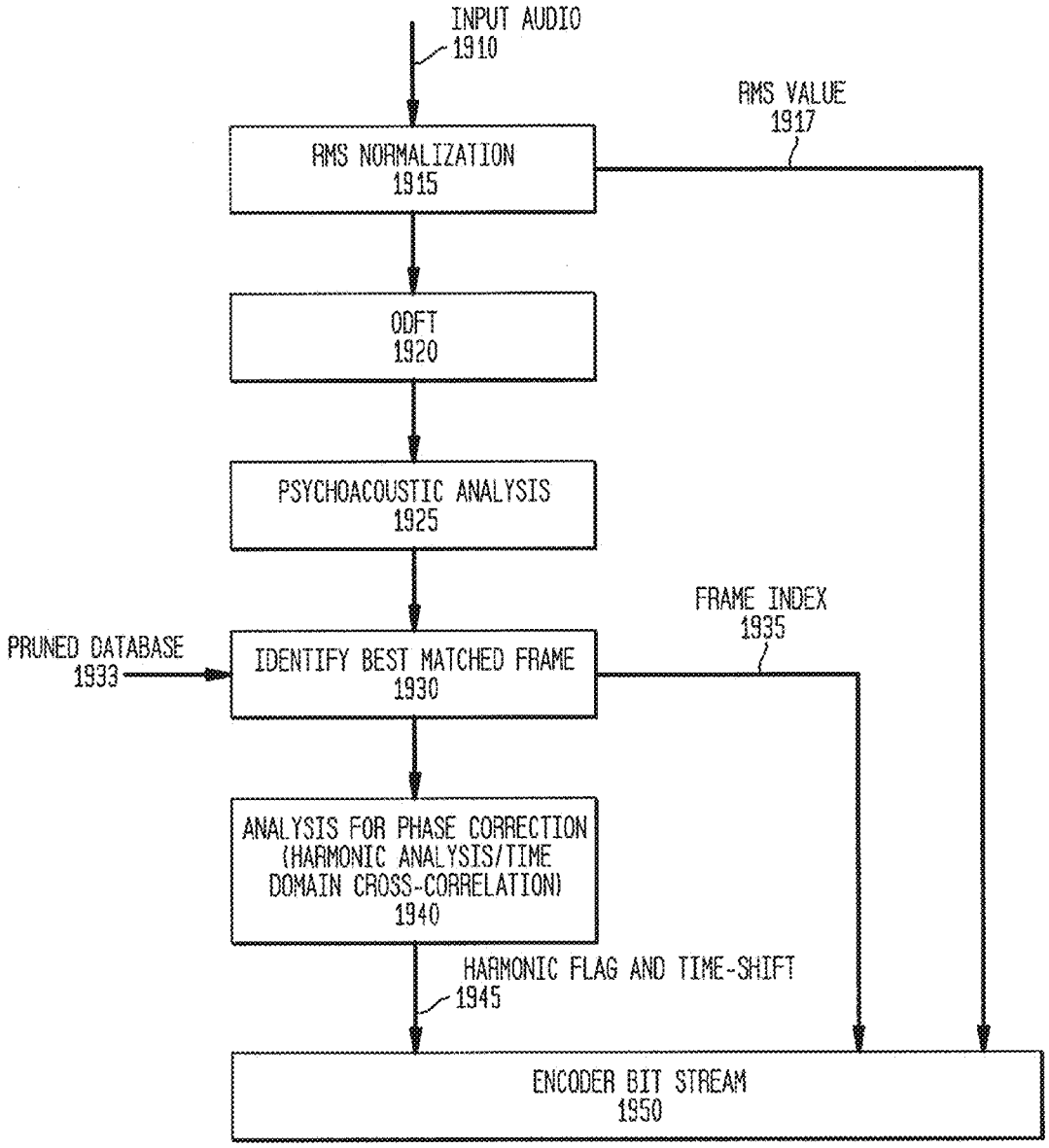
FIG. 19 is a process flow chart for an exemplary encoder algorithm according to an exemplary embodiment of the present invention.
Figure 20:
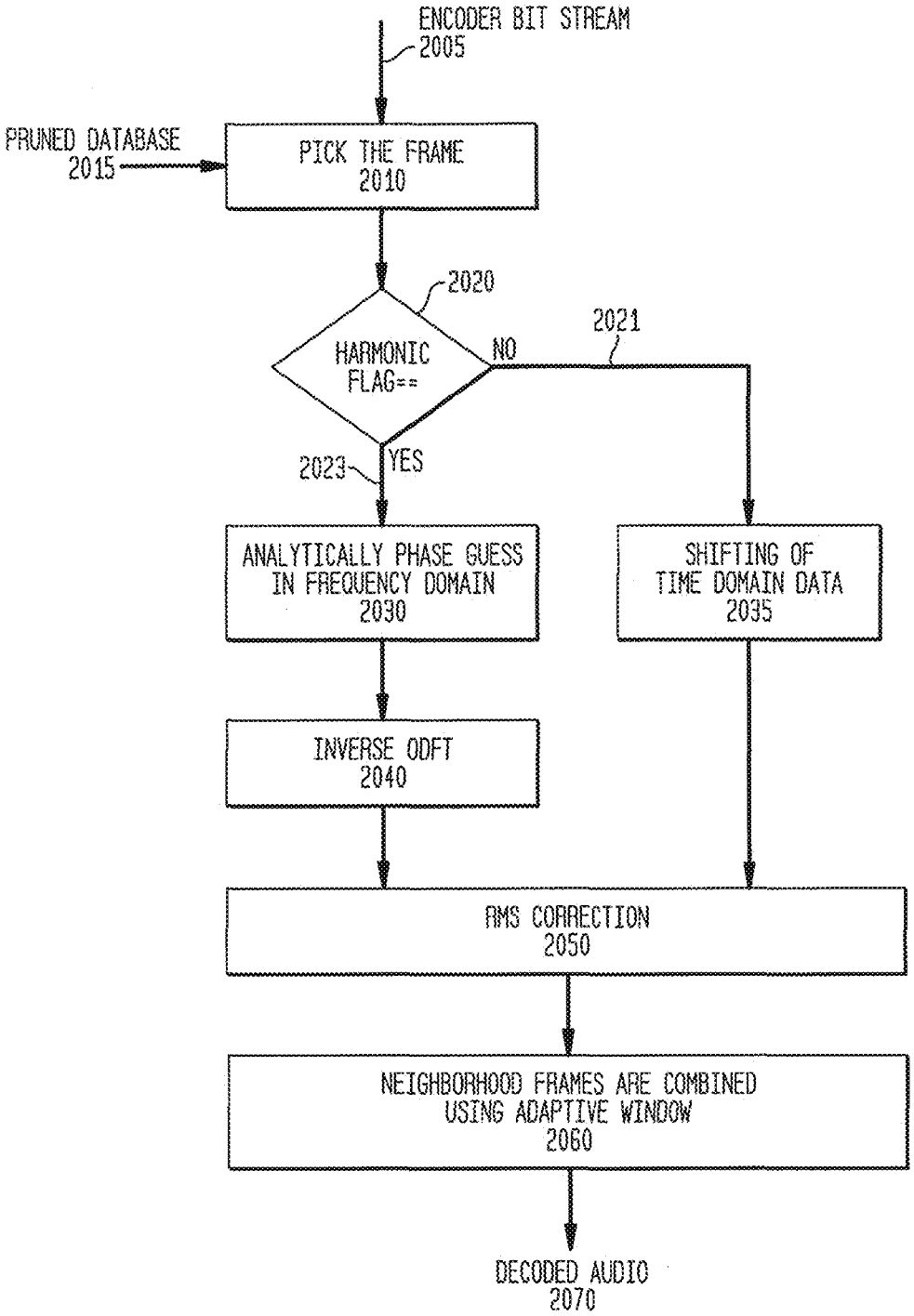
FIG. 20 is a process flow chart for an exemplary decoder algorithm according to an exemplary embodiment of the present invention.

Given the above discussion, FIGS. 19-20 present exemplary encoder and decoder algorithms, respectively. These are next described.

FIG. 19 is an exemplary process flow chart of an exemplary encoder algorithm according to exemplary embodiments of the present invention. With reference thereto, input audio at 1910 is fed into an RMS normalization stage 1915, which then outputs an RMS value 1917 which is fed directly to encoded bit stream stage 1950. Simultaneously, from RMS normalization stage 1915, the output is fed into an ODFT stage 1920, and from there to a psychoacoustic analysis stage 1925. The analysis results are then fed into an Identify Best Matched Frame stage 1930, which, as noted above, must have access to a dictionary, or pruned database of preset packets 1933. Once a best matched frame is found, it can, for example, be processed for phase correction, as described above, using, for example, the two above-described techniques of harmonic analysis and time domain cross-correlation. Once this is done, Harmonic Flag And Time Shift information can, for example, be output, which, along with the Frame Index 1935 (the ID of the best matched preset packet, obtained from the dictionary entry) can be sent to be encoded, or broadcast, in Encoder Bit Stream 1950. Thus, Encoder Bit Stream 1950 is what is sent over a broadcast or communications channel, and as noted, it is significantly smaller bitwise than the corresponding sequence of compressed packets, even with using modification information to prune some of the most similar compressed audio packets.

FIG. 20 depicts an exemplary decoder algorithm (resident on a receiver or similar user device). It is with such a decoder that the encoder bit stream which was output at 1950 in FIG. 19, and received, for example, over a broadcast channel, can be processed. With reference thereto, processing begins with Encoder Bit Stream 2005. This is input, for example, to Pick The Frame module 2010, which gets the corresponding frame from the dictionary resident on the receiver that was designated by the "Frame Index" 1935 at the encoder, as described above. This module has access to a copy of Pruned Database 2015 stored on the receiver, which is a copy of the Pruned Database 1933 of FIG. 19 used by the encoder, and generated, as described above, with reference to FIG. 14.

Once the designated frame has been chosen, it remains to modify the frame, so as to even better match the originally encoded frame from Input Audio 1910. This can be done, for example, by using the results of Harmonic Analysis and Time Domain Cross-Correlation 1940, as described above with reference to FIG. 19. Thus, at 2020, it is determined if a harmonic flag has been set. If YES was returned at 2023, then the phase can be analytically predicted in the frequency domain at 2030, and an inverse ODFT performed at 2040. If no harmonic flag was set, and thus NO was returned at 2021, then Time Domain Data Shifting can occur at 2035. In either case, processing then moves to RMS Correction 2050, and then to 2060, where neighboring frames are combined using adaptive window, as described above. The output of this final processing stage 2060 is decoded audio 2070, which can then be played through the user device.

Broadcast Personalized Radio Using EBT

Figure 21:
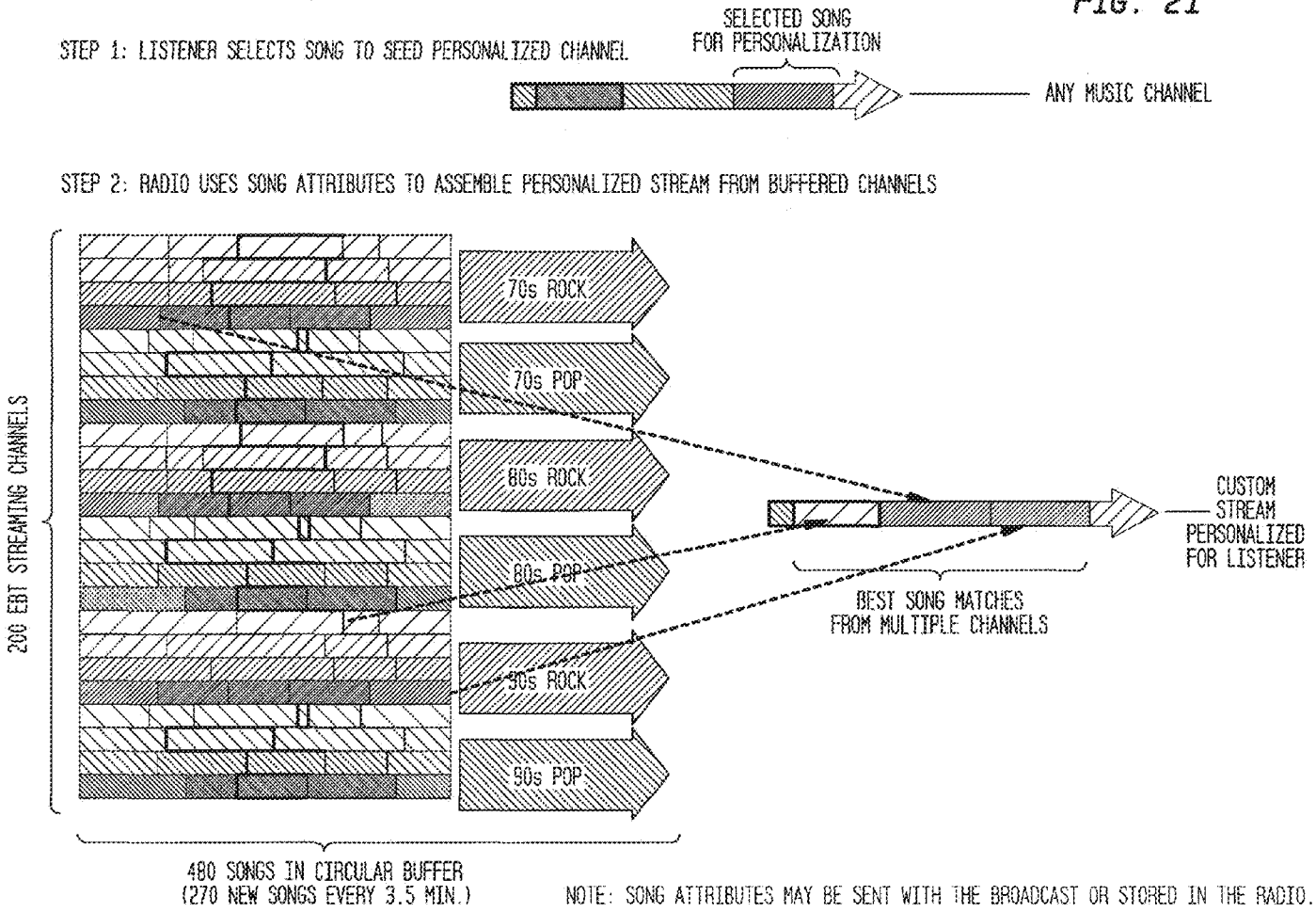

FIGS. 21-22 illustrate the use of an exemplary embodiment of the present invention to create a user personalized channel, but only using songs or audio clips then in the queue at any given time in a receiver. This can be uniquely accomplished using the techniques of the present invention, which can, for example, so greatly minimize the bandwidth needed to transmit a channel that multiple channels can be transmitted where only one could previously. Thus, with many more channels available, when a receiver buffers a set of channels in a circular buffer, as is often the case in modern receivers, using the novel bandwidth optimization technology described above, there can be many more EBT channels available in a broadcast stream, and thus many more channels available to buffer. This causes, at any given time, many more songs to be stored in such circular buffers. It is from this large palette of available content in a circular buffer that a given personalized channel module, resident and running on the receiver, for example, can draw. Using user preferences and chosen songs as seeds, an exemplary receiver can, in effect, automatically generate a personalized channel for that user. This is much easier to implement than an entire personalized stream, such as is the case with music services such as, for example, Pandora®, Slacker® and the like, and because it leverages a pre-existing broadcast infrastructure, there is no requirement that a user obtain network access, or spend money on data transfer minutes.

FIG. 21 illustrates two steps that can, for example, be used to generate such a personalized channel. In a first step a user selects a song to seed the channel. The song can come from any available channel offered by the broadcast service. In a second step, using various attributes of the song, an exemplary "personalizer" module on the receiver can assemble a personalized stream of songs or audio clips from the various buffered channels on the receiver. In the schema of FIG. 21, it is assumed that there are 200 EBT based channels streamed to the receiver, and thus 480 songs in the circular buffer of the receiver. Moreover, every 3.5 minutes 270 new songs are added. From this large palette of available content, which is a function of the many channels available due to each one using the techniques of the present invention to optimize (and thus minimize) the bandwidth needed to transmit it, the personalizer module can generate a custom stream of audio content personalized for the user/listener.

FIG. 22 illustrates example broadcast radio parameters that can impact the quality of a user personalization experience. These can include, for example, (i) the number of songs in a circular buffer, (ii) the number of similar genre channels, and (iii) the number of songs received by the receiver per minute. It is noted that adding, for example, 200 additional EBT channels to an existing broadcast offering can improve personalized stream accuracy by increasing the average attribute correlation factor in the stream. (It is noted that receipt of EBT channels, using the systems and methods described herein, requires additional enhancements to standard receivers. Thus, to remain compatible with an existing customer base and associated receivers, a broadcaster could, for example, maintain the prior service, and add EBT channels. New receivers could thus receive both, or just EBT channels, for example. An exemplary personalizer module could then draw on all available channels in the circular buffer to generate the personalized custom stream). It is further noted that, for example, in the Sirius XM Radio SDARS services, the highest improvement can be available with initial stream selections, with the EBT channels providing a 10× larger initial content library and a 4× larger ongoing content library than is currently available, as shown in FIG. 22.

Thus, in such a personalized radio channel, a programming group can, for example, define which channels/genres may be personalized. This can be defined over-the-air, for example. A programming group can also define song attributes to be used for personalization, and an exemplary technology team can determine how song attributes are delivered to a radio or other receiver. Based on content, attributes can, for example, be broadcast or, for example, be pre-stored in flash memory. The existence of many more EBT channels obtained by the disclosed methods can, for example, dramatically increase the content available for personal radio. The receiver buffers multiple songs at any one time, and can thus apply genre and preference matching algorithms to personalize a stream for any user.

High Level Codec Architecture and Psychoacoustic Model Processing

Figure 24:
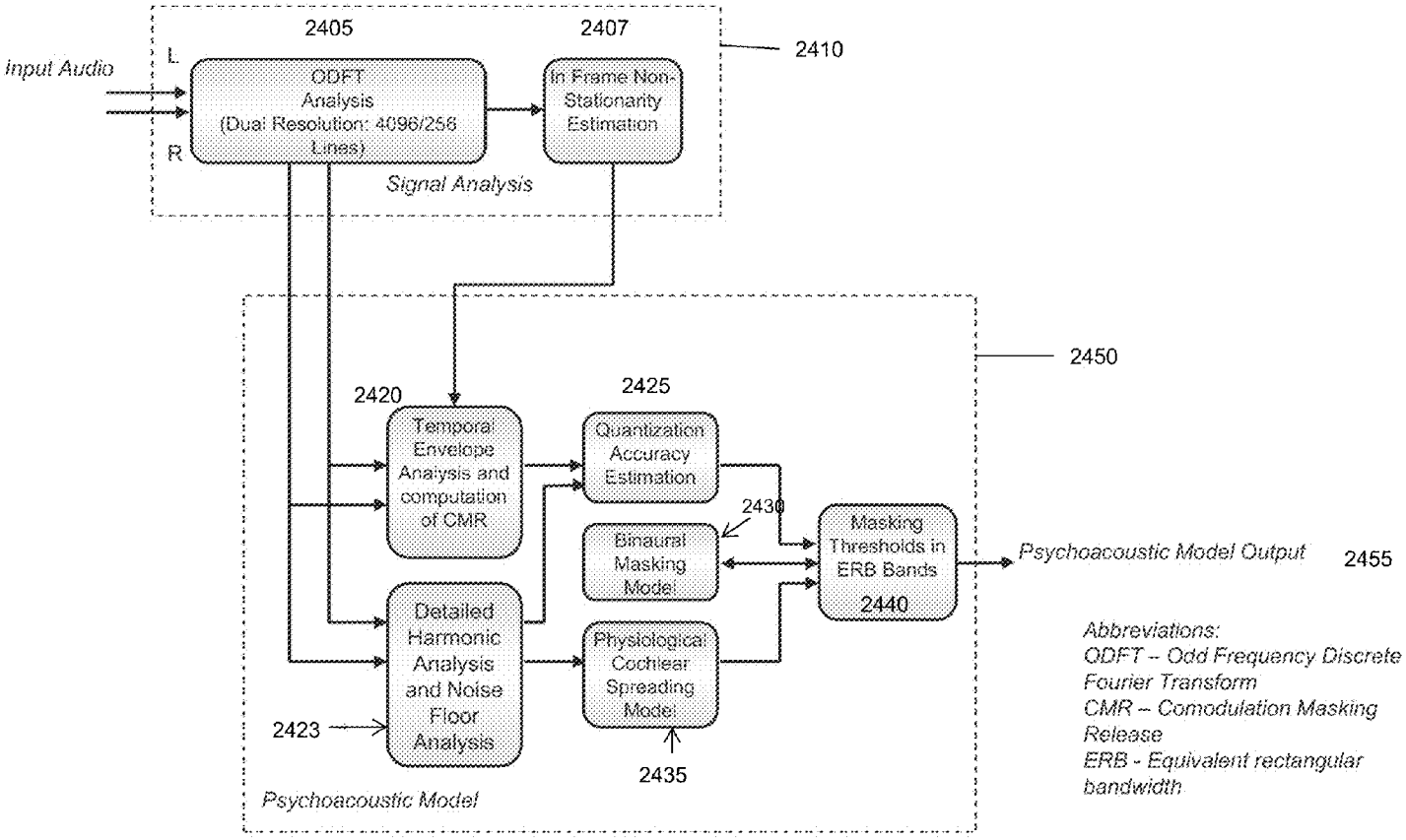
FIG. 24 depicts exemplary processing flow for an Accurate Psychoacoustic Model according to an exemplary embodiment of the present invention.
Figure 26:
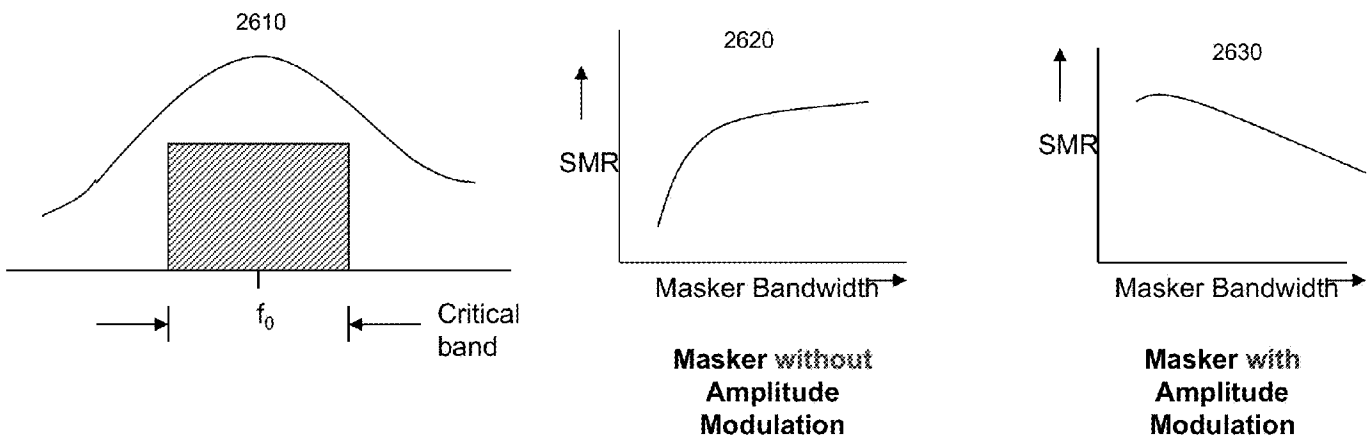
FIG. 26 illustrates exemplary wideband masking modeling considerations for The Accurate Psychoacoustic Model of FIG. 24

FIG. 23 illustrates an exemplary high level codec which may be used in various exemplary embodiments of the present invention. It is similar to the codec described above, with further details. It includes a novel psychoacoustic modeling component, which may, for example, have the processing structure as is shown in FIG. 24. FIGS. 25-27 focus on various aspects of this novel psychoacoustic model. Finally, FIGS. 29 and 30 provide exemplary match statistics for harmonic locations for five exemplary .wav audio clips. These various figures are next described.

FIG. 23 depicts an exemplary EBT2 Codec High Level Architecture according to an exemplary embodiment of the present invention. With reference thereto, beginning at the top left of FIG. 23, an audio signal is input to the exemplary codec and is fed into both a Time Frequency Envelope Estimation module 2301, as well as a Time Non-Stationary Estimation And Warping module 2305. We first describe the signal path from Time Frequency Envelope Estimation module 2301, then follow that with the path leading out of Time Non-Stationary Estimation And Warping module 2305.

From Time Frequency Envelope Estimation module 2301, its output is fed into Full Band Synthesis module 2340, at the bottom right of FIG. 23. Returning to Time Non-Stationary Estimation and Warping module 2305, its output is fed into a 4096 Point Odd Frequency Discrete Fourier Transform (ODFT) with 50% overlap at 2307. We first describe the signal path that exits to the right of module 2307. From module 2307 the output is fed into a Harmonic Analysis and Identification module 2310 which identifies harmonic patterns. The output of 2310 is itself fed into four separate modules, namely the Harmonic Synthesis module 2317; Quantized fo Values 2330; a Cepstrum Envelope Estimation and Coding module 2335 and a Dictionary Index Search module 2315, where harmonic indicators are searched for. This may be performed, for example, using an EBT2 Dictionary of, for example, 400,000 frames, but various other frame numbers may be used as well, obviously. The output of module 2315 is fed into 2327, which stores up to 8 such harmonic indices (but typically 3 to 4). The contents of each of modules 2337, 2335 and 2330 are then each fed into two modules, namely, High Frequency Synthesis module 2350 and Baseband Synthesis module 2360.

Returning to the signal pathway exiting to the bottom and left of module 2307, and commencing with the left hand side, the output of the ODFT is fed into a Psychoacoustic Modeling module 2320. Its output is then fed into Differential Coding of Baseband Peaks 2321, the output of which is then fed into baseband synthesis module 2360.

Returning once again to module 2307, its output is also fed into a summer 2319 and then summed with the output of Harmonic Synthesis module 2317. The sum is input to the Differential Coding of Baseband Peaks module 2321, as well as into a Dictionary Index Search module for flattened residuals at 2325. It is noted that modules 2315 and 2325 may be the same, although shown here as separate to avoid clutter in the figure. The output of the dictionary search is again fed into Baseband Synthesis module 2360. Thus, given all such processing, the output of the Baseband Synthesis module 2360 is input to both High Frequency Synthesis 2350 and Full Band Synthesis 2340, and additionally, the output of High Frequency Synthesis 2350 is also input to Full Band Synthesis 2340. (It is also noted that Full Band Synthesis also receives input from Time Frequency Envelope Estimation 2310, as noted above, and finally, out of Full Band Synthesis 2340 emerges Synthesized Audio 2390, shown at the bottom right of FIG. 23. This is the ultimate result of the EBT2 Codec.

Next described is FIG. 24, which depicts an exemplary Accurate Psychoacoustic Model such as, for example, may be used in Psychoacoustic Modelling module 2320 of FIG. 23, describe above. Beginning at the top left of FIG. 24, each of left and right channels of input audio are input to an ODFT Analysis module 2405 which may have, for example, dual resolution of 4096/256 lines. The output of module 2405 is then input to three separate modules. First, it is input to an In Frame Non-Stationarity Estimation module 2407. The output of module 2405 is also input, as left and right channels, to Temporal Envelope Analysis and Computation of CMR module 2420, and finally to Detailed Harmonic Analysis and Noise Floor Analysis module 2423. It is noted that the combination of modules 2405 and 2407 together comprise a Signal Analysis portion of the Psychoacoustic Model of FIG. 24. There is also a Psychoacoustic Model component 2450 of the overall psychoacoustic model of FIG. 24, which is further described below.

Continuing with reference to In Frame Non-Stationarity Estimate module 2407, its output is also input to Temporal Envelope Analysis of and Computation of CMR module 2420. Each of the outputs of modules 2420 and 2423 are then input to Quantization Accuracy Estimation module 2425, and the output of 2423 is further input to Physiological Cochlear Spreading Model module 2435.

Continuing at the bottom right of FIG. 24, the output of each of (i) Quantization Accuracy Module 2425 and (ii) Physiological Cochlear Spreading module 2435 are each fed into the Masking Thresholds in ERB Bands module 2440 which also shares data with Binaural Masking Model 2430. Finally, the output of module 2440 is the Psychoacoustic Model Output 2455. It is this signal that is then input to module 2321 of FIG. 23, namely the Differential Coding of Baseband Peaks module. As can readily be seen with reference to FIG. 24 and as noted, the model is divided into two portions, a Signal Analysis component 2410 and a Psychoacoustic Model Output component 2450. As also shown, the "CMR" computed in 2420 is a Comodulation Masking Release, and the ERB bands used in 2440 are Equivalent Rectangular Bandwidth bands.

As shown in FIG. 25, the Accurate Psychoacoustic Model depicted in FIG. 24 has certain useful properties. These include the ability to perform an accurate harmonic analysis to detect the presence of tones and harmonic components. This harmonic analysis includes, in exemplary embodiments of the present invention (i) new techniques for the estimation of tone frequencies (with sub-bin accuracy), magnitude and phase; (ii) cepstrum based algorithms for harmonic detection and finally (iii) correction based on hysteresis and likelihood models. The accurate harmonic analysis is illustrated in the three graphs shown at the bottom of FIG. 25.

FIGS. 26 and 27 present additional key details of the Accurate Psychoacoustic Model depicted in FIG. 24 according to various exemplary embodiments of the present invention.

With reference to FIG. 26, there are shown details of accurate modelling of wideband masking considerations. As shown, a masking threshold for a wideband masker (greater than critical band) can be substantially lower that a narrow band masker. This, known as "Comodulation Masking Release" (CMR) in hearing literature, may be, in exemplary embodiments of the present invention, rigorously modeled. For a given critical band centered at a frequency of fo, as shown in 2610, one can see, as depicted in 2620, the effect of a Masker without Amplitude Modulation, and at 2630 the effect of a Masker with Amplitude modulation. This Comodulation Masking Release, it should be recalled, is computed in the Temporal Envelope Analysis and Computation of CMR module 2420, of FIG. 24.

FIG. 27 illustrates an example of an Accurate Psychoacoustic Model used in AAC/PAC codecs (with 2048/256 frame lengths). This results in increased efficiency, on the order of a 9% reduction in bit demand, along with accuracy with improved harmonic analysis. Thus, with reference to FIG. 27, a comparison of per frame bit demand distribution using a conventional psychoacoustic model 2710, and the exemplary "accurate psychoacoustic model" 2720 is shown. As noted, an average 9% reduction in bit demand per frame is seen. FIG. 28 presents various details and specifications of an exemplary EBT2 Codec Structure according to exemplary embodiments of the present invention.

Exemplary Match Statistics for Harmonic Locations

FIGS. 29 and 30 provide exemplary match statistics for harmonic locations for five exemplary .wav audio clips. Details of these statistics are next described. It is noted that in calculating the match statistics, the total number of .wav files used to form an exemplary dictionary were as follows: 1172 (Rolling Stone DB+Iowa Single Instrument Databse+ Vocal/Voice files). Additionally, the total number of frames from the dictionary used to match the frames of the encoder: were 288060 (4096 sample frames). Finally, the fundamentals of the dictionary frames used to match the fundamentals of the Encoder frames were f0 and f, and the frequency until which an exact bin match was applied is 4 KHz.

Given these exemplary parameters, match statistics were calculated for harmonic locations for seven fundamental frequencies (F0 through F7) for each of five commonly known songs used as exemplary audio clips according to exemplary embodiments of the present invention. These results are presented in FIGS. 29 and 30. The exemplary audio clips include "Angie", "Beast of Burden", "Emotional Rescue", "Brown Sugar", and "Start Me Up". As can be seen from the data presented in FIGS. 29 and 30, for each audio clip there is a very high percentage of incidents of only one mismatch, and an even higher percentage of only two mismatches for each of the fundamental frequencies F0 to F7. It is also noted that in the case of the audio clip "Angie", a large percentage of the fundamentals experience no mismatches; if one mismatch is allowed, the percentages are very high, all essentially in the 90 to 100% range.

Although various methods, systems, and techniques have been described herein, the scope of coverage of this patent is not limited thereto. To the contrary, this patent covers all methods, systems, and articles of manufacture fairly falling within the scope of the appended claims.

What is claimed:

1. A method of transmitting an audio content stream, comprising:

encoding the audio content using a perceptual encoder to obtain a first series of compressed audio packets;

comparing each of the compressed audio packets in said first series of compressed packets with a database of compressed audio packets created using the same perceptual encoder, each of which has a unique identifier, and identifying a close match database packet for each first series compressed audio packet;

generating a sequence of said unique identifiers of said close match database packets to represent said first series of compressed audio packets and, if the close match database packet is not an exact match, a modification instruction or an error vector for each Identified close match database packet; and transmitting the sequence of (i) unique identifiers and (ii) associated modification instructions or error vectors across a communications channel to one or more receivers as part of a broadcast, in a form that at least one of the receivers can process to play to a user the audio content stream.

2. The method of claim 1, further comprising one of:

generating a modification instruction or an error vector for each identified close match database packet for each first series compressed audio packet, and sending said modification instruction or error vector with each of said unique identifiers in said sequence of unique identifiers; or generating a modification instruction or an error vector for each identified dose match database packet for each first series compressed audio packet, and sending said modification instruction or error vector with each of said unique identifiers in said sequence of unique identifiers, wherein the unique identifiers and modification instructions or error vectors are grouped and the bit length of each of said unique identifier and modification instruction or error vector grouping is 46 bits.

3. The method of claim 1, wherein said database of compressed audio packets is generated as follows:

obtain original audio content for a set of audio files;

encode a first audio file from said set using a perceptual encoder to obtain a series of compressed audio packets for said first audio file, and store said series of compressed audio packets in the database, each with a unique identifier;

for each additional audio file in the set of audio files:

encode the audio file using the perceptual encoder to obtain a series of compressed audio packets for the audio file;

compare each of the series of compressed audio packets for the additional audio file with the compressed audio packets stored in the database;

remove any of the compressed packets for the additional audio file that are similar by a defined metric to a compressed audio packet already stored in the database;

store the non-removed compressed packets for said additional audio file in the database, each with a unique identifier.

4. The method of claim 3, wherein at least one of:

said unique identifier is a unique identification number of between 20-30 bits;

said comparing each of the series of compressed audio packets for the additional audio file with the compressed audio packets stored in the database includes assigning a similarity score having at least 20 similarity gradations to each of said compressed audio packets for the additional audio file as regards each packet already stored in the database; and said comparing each of the series of compressed audio packets for the additional audio file with the compressed audio packets stored in the database includes assigning a similarity score having at least 20 similarity gradations to each of said compressed audio packets for the additional audio file as regards each packet already stored in the database; wherein said similarity score is a number between 1-5, with increments every 0.1 and with 1 being the most similar.

5. The method of claim 3, further comprising one of:

(i) following the storage of said series of compressed audio packets in the database for said first audio file, comparing said series of compressed audio packets stored in the database amongst each other, and removing ones of said series of compressed audio packets in the database for said first audio file that are similar to another compressed audio packet of said first audio file by a defined metric; and (ii) following the storage of said series of compressed audio packets in the database for said first audio file, comparing said series of compressed audio packets stored In the database amongst each other, and removing ones of said series of compressed audio packets in the database for said first audio file that similar to another compressed audio packet of said first audio file by a defined metric;

wherein said comparing each of the series of compressed audio packets for the first audio file amongst each other includes assigning a similarity score having at least 20 similarity gradations to each pair of said compressed audio packets for the first audio file.

6. The method of claim 5, wherein packets being determined to be similar is defined by a metric which includes having a similarity score of between 1 -1.4.

7. The method of claim 5, further comprising:

following the storage of said series of compressed audio packets in the database for said first audio file, comparing said series of compressed audio packets stored in the database amongst each other, and removing ones of said series of compressed audio packets in the database for said first audio file that are similar to another compressed audio packet of said first audio file by a defined metric, wherein said comparing each of the series of compressed packets for the additional audio file with those compressed packets stored in the database includes assigning a similarity score having at least 10 similarity gradations to each of said compressed packets for the additional audio file as regards each packet already stored in the database.

8. The method of claim 7, wherein said similarity score is a number between 1-5, with increments every 0.1and with 1 being the most similar.

9. The method of claim 8, wherein packets being determined to be similar is defined by a metric which includes having a similarity score of between 1-1.4.

10. The method of claim 1, wherein each of the compressed audio packets in the database of compressed audio packets was generated by:

encoding an audio file using a perceptual encoder to obtain a series of compressed packets for said first audio file, and storing one or more of the compressed packets.

11. The method of claim 1, wherein the unique identifier for each compressed packet in the database is a unique identification number of between 20-30 bits.

12. The method of claim 1, wherein each of the compressed audio packets in the database of compressed audio packets was generated by:

sampling a full length audio clip, and dividing it into segments of 2048 samples;

calculating an Odd Discrete Frequency Transform for each RMS normalized time domain segment;

performing psychoacoustic analysis over each segment to calculate masking thresholds corresponding to N quality indices;

analyzing each segment with other segments present in the database to identify the uniqueness of the segment;

removing any segment that is not unique by a defined metric;

storing the unique segments in the database as the compressed audio packets.

13. The method of claim 12, wherein each of said segments was considered as an examine frame, and each of said other segments present in the database was considered as a reference frame, and each examine frame was allocated a similarity index as per defined matching criteria.

14. The method of claim 13, wherein for said similarity index "1" was a best match and 5.0 was a worst match, with a step size of 0.2 between 1 and 5.

* * * * *